United States Patent [19]

Hoyen

[11] Patent Number: 4,572,892

[45] Date of Patent: Feb. 25, 1986

[54] DIRECT POSITIVE PHOTOGRAPHIC ELEMENTS WITH INCORPORATED MAXIMUM DENSITY ENHANCING ANTIFOGGANTS

[75] Inventor: Harry A. Hoyen, Webster, N.Y.

[73] Assignee: Eastman Kodak Company, Rochester, N.Y.

[21] Appl. No.: 741,928

[22] Filed: Jun. 6, 1985

Related U.S. Application Data

[63] Continuation-in-part of Ser. No. 612,511, May 21, 1984, abandoned.

[51] Int. Cl.[4] ..... G03C 5/24

[52] U.S. Cl. ..... 430/410; 430/409; 430/523; 430/598; 430/940

[58] Field of Search ..... 430/410, 409, 523, 539, 430/448, 598, 940

[56] References Cited

U.S. PATENT DOCUMENTS

| | | | |
|---|---|---|---|
| 2,497,917 | 2/1950 | Stauffer | 430/940 |
| 3,499,761 | 3/1970 | Dersch et al. | 430/614 |
| 3,671,255 | 6/1972 | Haga et al. | 430/614 |
| 3,761,276 | 9/1973 | Evans | 430/940 |
| 4,131,467 | 12/1978 | Bigelow | 430/614 |
| 4,444,865 | 4/1984 | Silverman et al. | 430/940 |
| 4,444,874 | 4/1984 | Silverman et al. | 430/409 |

OTHER PUBLICATIONS

*Research Disclosure,* vol. 151, Item 15162, Nov. 1976.

*Primary Examiner*—Won H. Louie
*Attorney, Agent, or Firm*—Carl O. Thomas

[57] ABSTRACT

A black and white direct positive photographic element intended for the formation of a viewable silver image is disclosed. One or more silver halide emulsion layers are present containing internal latent image forming silver halide grains. A maximum density enhancing antifoggant is located in an undercoat between the emulsion layer or layers and the support to impart an increase in photographic speed, an extended overexposure margin before encountering rereversal, a decrease in minimum density, and an increase in the covering power of developed silver.

11 Claims, 10 Drawing Figures

C-1

400X

E-1

400 X

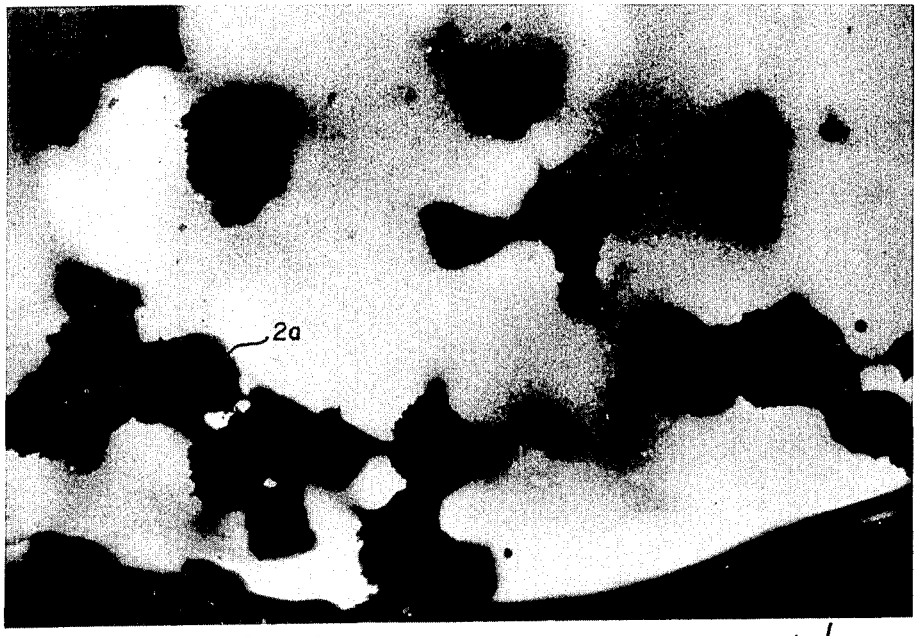
FIG. 5A 22,000x 1a
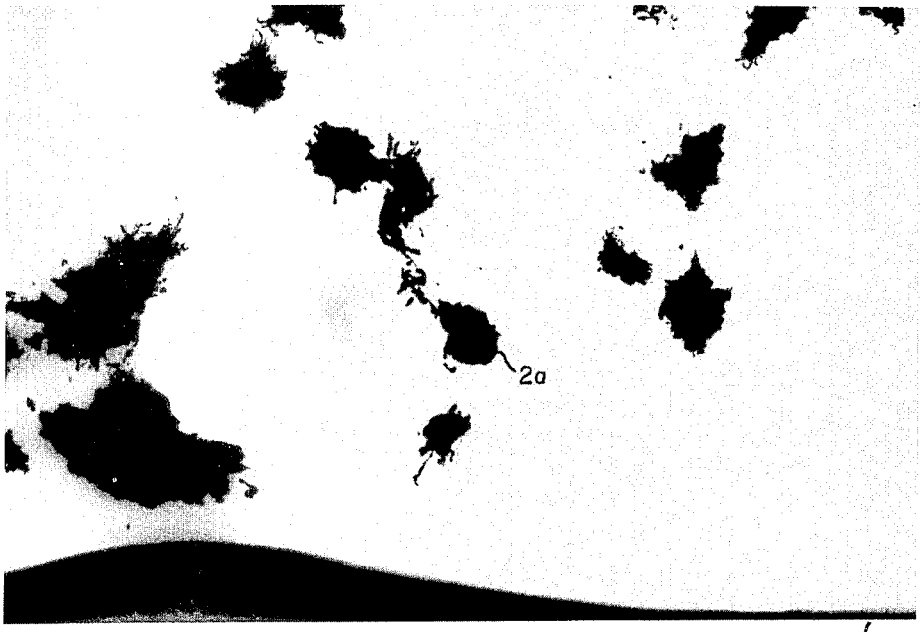
FIG. 5B 22,000x 1a

DIRECT POSITIVE PHOTOGRAPHIC ELEMENTS WITH INCORPORATED MAXIMUM DENSITY ENHANCING ANTIFOGGANTS

This invention relates to direct positive photographic elements intended to form silver images containing internal latent image forming silver halide grains and maximum density enhancing antifoggants. The invention further relates to processes of obtaining direct positive images from such photographic elements following imagewise exposure.

BACKGROUND OF THE INVENTION

Photographic elements which produce images having an optical density directly related to the radiation received on exposure are said to be negative working. A positive photographic image can be formed by producing a negative photographic image which is a negative of the first negative—that is, a positive image. A direct positive image is understood in photography to be a positive image that is formed without first forming a negative image. Direct positive photography is advantageous in providing a more straightforward approach to obtaining positive photographic images.

While silver halide photography offers the highest attainable photographic speeds for direct positive imaging, there are within the field of silver halide photography a surprising number of different approaches for direct positive imaging. A number of these approaches are reviewed in James, *The Theory of the Photographic Process,* 4th Ed., Macmillan 1977, Chapter 7, "Latent Image Effects Leading to Reversal and Desensitization".

Internal latent image desensitization type imaging is known to produce the highest attainable photographic speeds among the various direct positive silver halide imaging approaches. According to this approach a silver halide emulsion is employed containing internal latent image forming silver halide grains which are substantially free of surface fog. After imagewise exposure, the silver halide grains are developed with a surface developer—that is, one which will leave the latent image sites within the silver halide grains substantially unrevealed. Simultaneously, either by uniform light exposure or by the use of a nucleating agent, the silver halide grains are subjected to development conditions that would cause fogging of surface latent image forming silver halide grains. The internal latent image forming silver halide grains which received actinic radiation during imagewise exposure develop under these conditions at a slow rate as compared to the internal latent image forming silver halide grains remaining.

Stauffer U.S. Pat. No. 2,497,917 recognized that certain antifoggants when employed in internal latent image desensitization direct positive imaging not only reduce fog in minimum density areas, but also increase maximum density. Subsequently it has become the accepted practice in the art to employ maximum density enhancing antifoggants in internal latent image desensitization direct positive imaging. This special class of antifoggants are known to be useful whether incorporated directly in the photographic element or incorporated in a processing solution, such as a developer. Applications of maximum density enhancing antifoggants to more modern forms of internal latent image desensitization direct positive imaging are illustrated by Evans U.S. Pat. No. 3,761,276 and *Research Disclosure,* Vol. 151, November 1976, Item 15162. *Research Disclosure* is published at Emsworth Studios, 535 West End Avenue, New York, N.Y. 10024. Internal latent image desensitization direct positive imaging to produce silver images is specifically illustrated by Hoyen and Silverman U.S. Pat. Nos. 4,444,874 and 4,444,865.

Direct positive silver halide emulsions exhibit art recognized disadvantages as compared to negative working silver halide emulsions. Although internal latent image desensitization imaging is the highest speed approach to direct positive imaging with silver halide emulsions, direct positive photographic speeds are still not high as compared to those achieved routinely with negative working silver halide emulsions. Thus, there is a need in the art for improvements in the photographic speed of this imaging approach.

A second disadvantage of internal latent image desensitization direct positive imaging is that rereversal occurs on overexposure.

A schematic illustration of rereversal is provided in FIG. 1, which plots density versus exposure. A characteristic curve (stylized to exaggerate curve features for simplicity of discussion) is shown for a direct positive emulsion. When the emulsion is coated as a layer on a support, exposed, and processed, a density is produced. The characteristic curve is the result of plotting various levels of exposure versus the corresponding density produced on processing. At exposures below level A underexposure occurs and a maximum density is obtained which does not vary as a function of exposure. At exposure levels between A and B useful direct positive imaging can be achieved, since density varies inversely with exposure. If exposure occurs between the levels indicated by B and C, overexposure results. That is, density ceases to vary as a function of exposure in this range of exposures. If a subject to be photographed varies locally over a broad range of reflected light intensities, a photographic element containing the direct positive emulsion can be simultaneously exposed in different areas at levels less than A and greater than B. The result may, however, still be aesthetically pleasing, although highlight and shadow detail of the subject are both lost. If it is attempted to increase exposure for this subject, however, to pick up shadow detail, the result can be to increase highlight exposure to levels above C. When this occurs, rereversal is encountered. That is, the areas overexposed beyond exposure level C appear as highly objectionable negative images, since density is now increasing directly with exposure. Useful exposure latitude can be increased separating exposure levels A and B, but this is objectionable to the extent that it reduces contrast below optimum levels for most subjects. Therefore reduction in rereversal is most profitably directed to increasing the separation between exposure levels B and C so that overexposed areas are less likely to produce negative images. (In actual practice the various segments of the characteristic curve tend to merge more smoothly than illustrated.)

In silver halide photographic elements which produce dye images for viewing the form of the developed silver is of little concern, since the silver produced on development is an unwanted by-product of dye formation and is generally bleached from the photographic element. However, in black and white photography the usual practice is to rely on developed silver wholly or partially to produce the viewable image. The form of the silver produced on development can have important effects on image quality and the amount of silver required. One measure of the efficiency of silver use in black and white imaging is covering power. Although expressed in various units in the art, as herein employed covering power is defined as 100 times the ratio of maximum density to silver, expressed in grams per square decimeter. From this definition it is apparent that achieving an increase in the maximum density of a silver image without increasing silver coverage is expressed more succinctly as increasing covering power.

SUMMARY OF THE INVENTION

In one aspect this invention is directed to a black and white direct positive photographic element intended for the formation of a viewable silver image and comprised of a support, one or more radiation sensitive emulsion layers containing internal latent image forming silver halide grains, and a maximum density enhancing antifoggant. The photographic element is further characterized by the improvement wherein the maximum density enhancing antifoggant is located in an undercoat between the emulsion layers and the support.

In another aspect this invention is directed to processing in a surface developer an imagewise exposed photographic element according to this invention (a) in the presence of a nucleating agent or (b) with light flashing of the photographic element during processing.

Several highly useful advantages have been observed in the viewable silver image forming direct positive photographic elements and processes of this invention. An increase in photographic speed has been observed. In some instances desirable increases in contrast have also be realized. An extended overexposure margin before encountering rereversal has been observed. Additionally, both desirable decreases in minimum density and increases in covering power have been realized. Microscopic examinations of silver images produced have revealed an improvement in image quality due to the finer, more uniformly distributed silver filaments produced by processing.

BRIEF DESCRIPTION OF THE DRAWINGS

The invention can be better understood by reference to the following detailed description of preferred embodiments considered in conjunction with the drawings, in which

FIGS. 3A, 3B, 4A, 4B, 5A, and 5B are magnifications of imaged Control (A) and Example (B) elements.

DESCRIPTION OF THE PREFERRED EMBODIMENTS

Figure 1:
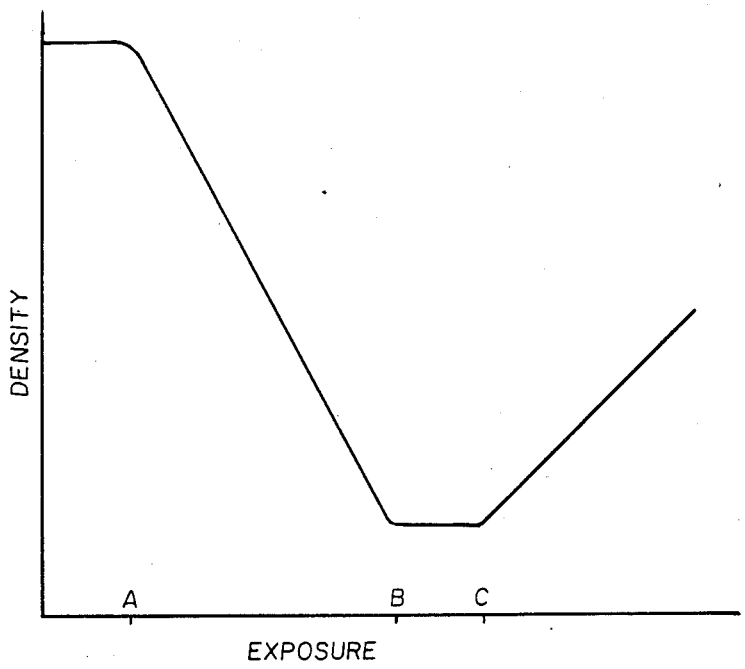
FIG. 1 is a stylized characteristic curve of a direct positive emulsion.

The present invention is generally applicable to black and white direct positive photographic elements intended for use in forming a viewable retained silver image. The photographic elements have coated on a support one or more radiation sensitive emulsion layers containing internal latent image forming silver halide grains. To achieve the advantages of this invention a maximum density enhancing antifoggant is located in an undercoat between the emulsion layer or layers and the support. For economy of expression this undercoat is hereinafter referred to as "the antifoggant undercoat"

Whereas the art has heretofore located maximum density enhancing antifoggant either in the silver halide emulsion layer of a black and white direct positive photographic element or in a processing solution therefor, the photographic elements of this invention position these maximum density enhancing antifoggants between the silver halide emulsion layer or layers and the photographic support. Stated another way, the antifoggant undercoat lies nearer the support than any radiation sensitive silver halide emulsion imaging layer.

In general any of the maximum density enhancing antifoggants recognized to be useful in internal latent image desensitization direct positive imaging can be employed in the practice of this invention, singly or in combination. Useful maximum density enhancing antifoggants are azoles and azines. Such azoles and azines have an $$-\overset{\overset{\displaystyle R^1}{|}}{N}- \qquad \text{(I)}$$

group in the azole or azine ring, wherein $R^1$ represents hydrogen or an alkali hydrolyzable group. Specific illustrations of such maximum density enhancing antifoggants are disclosed by Stauffer U.S. Pat. No. 2,497,917, Evans U.S. Pat. No. 3,761,276, and *Research Disclosure* Item 15162, cited above, each here incorporated by reference.

Specifically preferred maximum density enhancing antifoggants are 1,2,3-triazoles, including those having a fused aromatic ring structure, such as benzotriazoles. Illustrative of specifically preferred maximum density enhancing 1,2,3-triazole antifoggants are those set forth in Table I.

TABLE I

| | |
|---|---|
| AF-1 | Benzotriazole |
| AF-2 | 5-Bromobenzotriazole |
| AF-3 | 5-Methylbenzotriazole |
| AF-4 | 4-Nitro-6-chlorobenzotriazole |
| AF-5 | 1-Phenylcarbamoyl-5-methylbenzotriazole |
| AF-6 | 1-Cyclohexylcarbamoyl-5,6-dichlorobenzotriazole |
| AF-7 | 1-(p-Hexadecanesulfonamidobenzoyl)benzotriazole |
| AF-8 | 1,2,3-Triazole-4,5-dicarboxylic acid |
| AF-9 | 5-Nitrobenzotriazole |
| AF-10 | 5,6-Dichlorobenzotriazole |
| AF-11 | 5-Chlorobenzotriazole |

The maximum density enhancing antifoggants can be employed in any effective amount. Generally concentrations of 0.1 mole per mole of silver or less are employed in the practice of this invention. The maximum density enhancing antifoggants, particularly the 1,2,3-triazole antifoggants described above, are preferably incorporated in the photographic element beneath the radiation sensitive silver halide emulsion layer or layers in the antifoggant undercoat in a concentration of from $5\times10^{-4}$ to 0.1 mole per mole of silver, preferably $10^{-3}$ to $5\times10^{-2}$ mole per mole of silver, when no other source of maximum density enhancing antifoggant is supplied. When another source of maximum density enhancing antifoggant is supplied, the concentration of maximum density enhancing antifoggant in the antifoggant undercoat can, but need not, be reduced. For example, it is conventional to incorporate maximum density enhancing antifoggants in processing solutions in concentrations ranging from about $5\times10^{-2}$ to 3 grams per liter. Even with these conventional levels of maximum density enhancing antifoggants in the processing solutions employed, advantages can be achieved by the presence of maximum density enhancing antifoggant in the antifoggant undercoat.

In addition to the maximum density enhancing antifoggant the antifoggant undercoat preferably includes a dispersing medium to facilitate coating of the maximum density enhancing antifoggant at the desired coverage. The dispersing medium can be chosen from among those conventionally employed in silver halide emulsion and other processing solution permeable layers of photographic elements, more specifically described below.

In addition to the antifoggant undercoat the photographic elements of this invention additionally include one or more radiation sensitive silver halide emulsion layers containing internal latent image forming silver halide grains.

As employed herein, the terms "internal latent image forming silver halide grains" and "silver halide grains capable of forming an internal latent image" are employed in the art-recognized sense of designating silver halide grains which produce substantially higher optical densities when coated, imagewise exposed, and developed in an internal developer than when comparably coated, exposed and developed in a surface developer. Preferred internal latent image forming silver halide grains are those which, when examined according to normal photographic testing techniques, by coating a test portion on a photographic support (e.g., at a coverage of from 3 to 4 grams per square meter), exposing to a light intensity scale (e.g., with a 500-watt tungsten lamp at a distance of 61 cm) for a fixed time (e.g., between $1\times10^{-2}$ and 1 second) and developing for 5 minutes at 25° C. in Kodak Developer DK-50 (a surface developer), provide a density of at least 0.5 less than when this testing procedure is repeated, substituting for the surface developer Kodak Developer DK-50 containing 0.5 gram per liter of potassium iodide (an internal developer). The internal latent image forming silver halide grains most preferred for use in the practice of this invention are those which, when tested using an internal developer and a surface developer as indicated above, produce an optical density with the internal developer at least 5 times that produced by the surface developer. It is additionally preferred that the internal latent image forming silver halide grains produce an optical density of less than 0.4 and, most preferably, less than 0.25 when coated, exposed and developed in surface developer as indicated above, that is, the silver halide grains are preferably initially substantially unfogged and free of latent image on their surface.

The surface developer referred to herein as Kodak Developer DK-50 is described in the *Handbook of Chemistry and Physics,* 30th edition, 1947, Chemical Rubber Publishing Company, Cleveland, Ohio, page 2558, and has the following composition:

| | |
|---|---|
| Water, about 52° C. | 500.0 cc |
| N—methyl-p-aminophenol hemisulfate | 2.5 g |
| Sodium sulfite, desiccated | 30.0 g |
| Hydroquinone | 2.5 g |
| Sodium metaborate | 10.0 g |
| Potassium bromide | 0.5 g |
| Water to make | 1.0 liter. |

Internal latent image forming silver halide grains which can be employed in the practice of this invention are well known in the art. Patents teaching the use of internal latent image forming silver halide grains in photographic emulsions and elements include Davey et al U.S. Pat. No. 2,592,250, Porter et al U.S. Pat. No. 3,206,313, Milton U.S. Pat. No. 3,761,266, Ridgway U.S. Pat. No. 3,586,505, Gilman et al U.S. Pat. No. 3,772,030, Gilman et al U.S. Pat. No. 3,761,267, Evans U.S. Pat. No. 3,761,276, and Atwell et al U.S. Pat. No. 4,035,185, the disclosures of which are hereby incorporated by reference.

Preferred internal latent image forming silver halide emulsions are core-shell emulsions. Such emulsions contain internal latent image forming silver halide grains which are internally sensitized. The internal or core portion of the silver halide grain which is sensitized is covered with an additional portion of silver halide, referred to as a shell. The primary function of the shell is to prevent access of surface developer to latent image sites which are located internally by reason of the internal chemical sensitization. As employed herein the term "core-shell" is intended to include any silver halide emulsion having these properties without regard to its method of manufacture.

Useful core-shell emulsions can be prepared by first forming a sensitized core emulsion. The core emulsion can be comprised of silver bromide, silver chloride, silver chlorobromide, silver chloroiodide, silver bromoiodide, or silver chlorobromoiodide grains. The grains can be coarse, medium, or fine and can be bounded by {100}, {111}, {110} crystal planes or combinations thereof. The coefficient of variation of the core grains should be no higher than the desired coefficient of variation of the completed core-shell grains.

Perhaps the simplest manipulative approach to forming sensitized core grains is to incorporate a metal dopant within the core grains as they are being formed. The metal dopant can be placed in the reaction vessel in which core grain formation occurs prior to the introduction of silver salt. Alternately the metal dopant can be introduced during silver halide grain growth at any stage of precipitation, with or without interrupting silver and/or halide salt introduction.

Iridium is specifically contemplated as a metal dopant. It is preferably incorporated within the silver halide grains in concentrations of from about $10^{-8}$ to $10^{-4}$ mole per mole of silver. The iridium can be conveniently incorporated into the reaction vessel as a water soluble salt, such as an alkali metal salt of a halogen-iridium coordination complex, such as sodium or potassium hexachloroiridate or hexabromoiridate. Specific examples of incorporating an iridium dopant are provided by Berriman U.S. Pat. No. 3,367,778.

Lead is also a specifically contemplated metal dopant for core grain sensitization. Lead is a common dopant in direct print and printout emulsions and can be employed in the practice of this invention in similar concentration ranges. It is generally preferred that the lead dopant be present in a concentration of at least $10^{-4}$ mole per mole of silver. Concentrations up to about $5\times10^{-2}$, preferably $2\times10^{-2}$, mole per mole of silver are contemplated. Lead dopants can be introduced similarly as iridium dopants in the form of water soluble salts, such as lead acetate, lead nitrate, and lead cyanide. Lead dopants are particularly illustrated by McBride U.S. Pat. No. 3,287,136 and Bacon U.S. Pat. No. 3,531,291.

Another technique for sensitizing the core grains is to stop silver halide grain precipitation after the core grain has been produced and to sensitize chemically the surface of the core. Thereafter additional precipitation of silver halide produces a shell surrounding the core. Particularly advantageous chemical sensitizers for this purpose are middle chalcogen sensitizers—i.e., sulfur, selenium, and/or tellurium sensitizers. Middle chalcogen sensitizers are preferably employed in concentrations in the range of from about 0.05 to 15 mg per silver mole. Preferred concentrations are from about 0.1 to 10 mg per silver mole. Further advantages can be realized by employing a gold sensitizer in combination. Gold sensitizers are preferably employed in concentrations ranging from 0.5 to 5 times that of the middle chalcogen sensitizers. Preferred concentrations of gold sensitizers typically range from about 0.01 to 40 mg per mole of silver, most preferably from about 0.1 to 20 mg per mole of silver. Controlling contrast by controlling the ratio of middle chalcogen to gold sensitizer is particularly taught by Atwell et al U.S. Pat. No. 4,035,185, cited above and here incorporated by reference specifically for this teaching. Evans U.S. Pat. No. 3,761,276, cited above, provides specific examples of middle chalcogen core grain sensitizations.

Although preferred, it is not essential that the core grains be chemically sensitized prior to shelling to form the completed core-shell grains. It is merely necessary that the core-shell grains as formed be capable of forming internal latent image sites. Internal sensitization sites formed by shelling of sensitized core grains—that is, occlusion of foreign (i.e., other than silver and halogen) materials within the core-shell grains—are hereinafter referred to as internal chemical sensitization sites to distinguish them from internal physical sensitization sites. It is possible to incorporate internal physical sensitization sites by providing irregularities in the core-shell grain crystal lattice. Such internal irregularities can be created by discontinuities in silver halide precipitation or by abrupt changes in the halide content of the core-shell grains. For example, it has been observed that the precipitation of a silver bromide core followed by shelling with silver bromoiodide of greater than 5 mole percent iodide requires no internal chemical sensitization to produce a direct positive image.

Although the sensitized core emulsion can be shelled by the Ostwald ripening technique of Porter et al U.S. Pat. No. 3,206,313, cited above, it is preferred that the silver halide forming the shell portion of the grains be precipitated directly onto the sensitized core grains by the double jet addition technique. Double jet precipitation is well known in the art, as illustrated by *Research Disclosure,* Vol. 176, December 1978, Item 17643, Section I, here incorporated by reference. The halide content of the shell portion of the grains can take any of the forms described above with reference to the core emulsion. To improve developability it is preferred that the shell portion of the grains contain at least 80 mole percent chloride, the remaining halide being bromide or bromide and up to 10 mole percent iodide. (Except as otherwise indicated, all references to halide percentages are based on silver present in the corresponding emulsion, grain, or grain region being discussed.) Improvements in low intensity reciprocity failure are also realized when the shell portion of the core-shell grains is comprised of at least 80 mole percent chloride, as described above. For each of these advantages silver chloride is specifically preferred. On the other hand, the highest realized photographic speeds are generally recognized to occur with predominantly bromide grains, as taught by Evans U.S. Pat. No. 3,761,276, cited above. Thus, the specific choice of a preferred halide for the shell portion of the core-shell grains will depend upon the specific photographic application. When the same halides are chosen for forming both the core and shell portions of the core-shell grain structure, it is specifically contemplated to employ double jet precipitation for producing both the core and shell portions of the grains without interrupting the introduction of silver and halide salts in the transition from core to shell formation.

The silver halide forming the shell portion of the core-shell grains must be sufficient to restrict developer access to the sensitized core portion of the grains. This will vary as a function of the ability of the developer to dissolve the shell portion of the grains during development. Although shell thicknesses as low as a few crystal lattice planes for developers having very low silver halide solvency are taught in the art, it is preferred that the shell portion of the core-shell grains be present in a molar ratio with the core portion of the grains of about 1:4 to 8:1, as taught by Porter et al U.S. Pat. No. 3,206,313 and Atwell et al U.S. Pat. No. 4,035,185, cited above.

The amount of overexposure which can be tolerated by the emulsions of this invention without encountering rereversal can be increased by incorporating into the core-shell grains metal dopants for this purpose. As employed herein the term "rereversal" refers to the negative working characteristic exhibited by an overexposed direct positive emulsion. (Rereversal is the converse of solarization, a positive working characteristic exhibited by an overexposed negative working emulsion.) Hoyen U.S. Pat. No. 4,395,478, incorporated by reference, discloses the use of polyvalent metal ions as dopants in the shell of core-shell emulsions to reduce rereversal. Preferred metal dopants for this purpose are divalent and trivalent cationic metal dopants, such as cadmium, zinc, lead, and erbium. These dopants are generally effective at concentration levels below about $5\times10^{-4}$, preferably below $5\times10^{-5}$, mole per mole of silver. Dopant concentrations of at least $10^{-6}$, preferably at least $5\times10^{-6}$, mole per silver mole, should be present in the reaction vessel during silver halide precipitation. The rereversal modifying dopant is effective if introduced at any stage of silver halide precipitation. The rereversal modifying dopant can be incorporated in either or both of the core and shell. It is preferred that the dopant be introduced during the latter stages of precipitation (e.g., confined to the shell) when the core-shell grains are high aspect ratio tabular grains. The metal dopants can be introduced into the reaction vessel as water soluble metal salts, such as divalent and trivalent metal halide salts. Zinc, lead, and cadmium dopants for silver halide in similar concentrations, but to achieve other modifying effects, are disclosed by McBride U.S. Pat. No. 3,287,136, Mueller et al U.S. Pat. No. 2,950,972, Iwaosa et al U.S. Pat. No. 3,901,711, and Atwell U.S. Pat. No. 4,269,927. Other techniques for improving rereversal characteristics discussed below can be employed independently or in combination with the metal dopants described.

After precipitation of a shell portion onto the sensitized core grains to complete formation of the core-shell grains, the emulsions can be washed, if desired, to remove soluble salts. Conventional washing techniques can be employed, such as those disclosed by *Research Disclosure,* Item 17643, cited above, Section II, here incorporated by reference.

Since the core-shell emulsions are intended to form internal latent images, intentional sensitization of the surfaces of the core-shell grains is not essential. However, to achieve the highest attainable reversal speeds, it is preferred that the core-shell grains be surface chemically sensitized, as taught by Evans U.S. Pat. No. 3,761,276 and Atwell et al U.S. Pat. No. 4,035,185, cited above. Any type of surface chemical sensitization known to be useful with corresponding surface latent image forming silver halide emulsions can be employed, such as disclosed by *Research Disclosure,* Item 17643, cited above, Section III. Middle chalcogen and/or noble metal sensitizations, as described by Atwell et al U.S. Pat. No. 4,035,185, cited above, are preferred. Sulfur, selenium, and gold are specifically preferred surface sensitizers.

The degree of surface chemical sensitization is limited to that which will increase the reversal speed of the internal latent image forming emulsion, but which will not compete with the internal sensitization sites to the extent of causing the location of latent image centers formed on exposure to shift from the interior to the surface of the tabular grains. Thus, a balance between internal and surface sensitization is preferably maintained for maximum speed, but with the internal sensitization predominating. Tolerable levels of surface chemical sensitization can be readily determined by relating surface development to internal development as previously described.

In one specifically preferred form the core-shell emulsions employed in the practice of this invention are high aspect ratio tabular grain core-shell emulsions, as disclosed by *Research Disclosure,* Vol. 225, January, 1983, Item 22534, and Evans et al U.S. Ser. No. 564,976, filed Nov. 21, 1983, commonly assigned, both here incorporated by reference. As applied to the emulsions the term "high aspect ratio" is herein defined as requiring that the core-shell grains having a thickness of less than 0.5 micron (preferably 0.3 micron) and a diameter of at least 0.6 micron have an average aspect ratio of greater than 8:1 and account for at least 50 percent of the total projected area of the core-shell silver halide grains.

As employed herein the term "aspect ratio" refers to the ratio of the diameter of the grain to its thickness. The "diameter" of the grain is in turn defined as the diameter of a circle having an area equal to the projected area of the grain as viewed in a photomicrograph of an emulsion sample. The core-shell tabular grains of Evans et al have an average aspect ratio of greater than 8:1 and preferably have an average aspect ratio of greater than 10:1. Under optimum conditions of preparation aspect ratios of 50:1 or even 100:1 are contemplated. As will be apparent, the thinner the grains, the higher their aspect ratio for a given diameter. Typically grains of desirable aspect ratios are those having an average thickness of less than 0.5 micron, preferably less than 0.3 micron, and optimally less than 0.2 micron. Typically the tabular grains have an average thickness of at least 0.05 micron, although even thinner tabular grains can in principle be employed. In a preferred form of the invention the tabular grains account for at least 70 percent and optimally at least 90 percent of the total projected surface area of the core-shell silver halide grains. Tabular grain average diameters are in all instances less than 30 microns, preferably less than 15 microns, and optimally less than 10 microns.

It is specifically contemplated to blend the internal latent image forming emulsions to satisfy specific emulsion layer requirements. For example, two or more emulsions differing in average grain diameter can be blended. It is specifically contemplated to employ in blending internal latent image forming grains of similar grain size distribution to minimize migration of addenda between different grain populations. When separate emulsions of similar grain size distribution are employed in combination, their performance can be differentiated by differences in surface sensitization levels, differences relating to adsorbed nucleating agents, or differences in proportions of internal sensitizers, the latter being taught by Atwell et al U.S. Pat. No. 4,035,185. Hoyen et al U.S. Pat. Nos. 4,444,874 and 4,444,865, here incorporated by reference, disclose that the blending or double coating of a first, core-shell emulsion and a second, internal latent image forming or internally fogged emulsion in a weight ratio of from 1:5 to 5:1, wherein a first emulsion exhibits a coefficient of variation of less than 20% and a second emulsion has an average grain diameter less than 70% that of the first emulsion, can result in an increase in silver covering power. A speed increase can also be realized, even at reduced coating levels. The ratio of the first emulsion to the second emulsion is preferably 1:3 to 2:1, based on weight of silver, and the average diameter of the grains of the second emulsion is preferably less than 50%, optimally less than 40% the average diameter of the grains of the first emulsion.

In a specifically preferred form of the invention the grains of the second emulsion are also core-shell grains. They can be identical to the core-shell grains of the first emulsion, subject to the considerations noted above. In general, when the second core-shell grain population satisfies the relative size requirements of the two grain populations the other considerations will also be satisfied when the first and second grain populations are of the same silver halide composition and similarly internally sensitized. Maintaining the second grain population substantially free of intentional surface chemical sensitization is also advantageous both in reducing the surface latent image forming capability of the second grain population within the direct positive exposure latitude of the blended emulsion and in increasing the reversal speed of the blended emulsion. It is specifically preferred to blend core-shell emulsions having surface chemical sensitization of the type disclosed by Evans U.S. Pat. No. 3,761,176 and Atwell et al U.S. Pat. No. 4,035,185, cited above, to form the first grain population with similar core-shell grains of smaller average grain size and free of or exhibiting reduced surface chemical sensitization forming the second grain population.

The internal latent image forming emulsions can, if desired, be spectrally sensitized. For black and white imaging applications spectral sensitization is not required, although orthochromatic or panchromatic sensitization is usually preferred. Generally, any spectral sensitizing dye or dye combination known to be useful with a negative working silver halide emulsion can be employed with the internal latent image forming emulsions. Illustrative spectral sensitizing dyes are those disclosed in *Research Disclosure,* Item 17643, cited above, Section IV. Particularly preferred spectral sensitizing dyes are those disclosed in *Research Disclosure,* Item 15162, cited above, here incorporated by reference. Although the emulsions can be spectrally sensitized with dyes from a variety of classes, preferred spectral sensitizing dyes are polymethine dyes, which include cyanine, merocyanine, complex cyanine and merocyanine (i.e., tri-, tetra, and poly-nuclear cyanine and merocyanine), oxonol, hemioxonol, styryl, merostyryl, and streptocyanine dyes. Cyanine and merocyanine dyes are specifically preferred. Spectral sensitizing dyes which sensitize surface fogged direct positive emulsions generally desensitize both negative working emulsions and the surface development of internal latent image forming emulsions and therefore are not normally contemplated for use in the practice of this invention. Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization or can entirely precede surface chemical sensitization. Sensitization can be enhanced by pAg adjustment, including cycling, during chemical and/or spectral sensitization.

It has been found advantageous to employ nucleating agents in preference to uniform light exposure in processing. The term "nucleating agent" (or "nucleator") is employed herein in its art-recognized usage to mean a fogging agent capable of permitting the selective development of internal latent image forming silver halide grains which have not been imagewise exposed in preference to the development of silver halide grains having an internal latent image formed by imagewise exposure.

The internal latent image forming emulsions preferably incorporate a nucleating agent to promote the formation of a direct positive image upon processing. The nucleating agent can be incorporated in the emulsion during processing, but it is preferably incorporated in manufacture of the photographic element, usually prior to coating. This reduces the quantities of nucleating agent required. The quantities of nucleating agent required can also be reduced by restricting the mobility of the nucleating agent in the photographic element. Large organic substituents capable of performing at least to some extent a ballasting function are commonly employed. Nucleating agents which include one or more groups to promote adsorption to the surface of the silver halide grains have been found to be effective in extremely low concentrations.

A preferred general class of nucleating agents for use in the practice of this invention are aromatic hydrazides. Particularly preferred aromatic hydrazides are those in which the aromatic nucleus is substituted with one or more groups to restrict mobility and, preferably, promote adsorption of the hydrazide to silver halide grain surfaces. More specifically, preferred hydrazides are those embraced by formula (II) below:

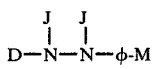

(II)

wherein

D is an acyl group;

J is in one occurrence hydrogen and in the other occurrence hydrogen or a sulfinic acid radical;

$\phi$ is a phenylene or substituted (e.g., halo-, alkyl-, or alkoxy-substituted) phenylene group; and M is a moiety capable of restricting mobility, such as a ballasting or an adsorption promoting moiety.

The incorporation of a sulfinic acid radical substituent in an aromatic hydrazide nucleating agent is specifically taught by Hess et al U.S. Pat. No. 4,478,928. The sulfinic acid radical substituent has an activating effect permitting increased levels of nucleating agent activity to be realized. Reduced rereversal can also be achieved. The sulfinic acid radical substituent is preferably in the $\beta$ position relative to the acyl group.

The term "sulfinic acid radical" is herein defined as the radical produced by the removal of the acid hydrogen ion from a sulfinic acid. Thus, the sulfinic acid radical can be produced from any conventional sulfinic acid. The sulfonyl group of the sulfinic acid can be bonded directly to either an aliphatic or aromatic residue. The aliphatic residue can, for example, be an alkyl substituent. A simple alkyl substituent can take the form of alkyl of from 1 to 8 carbon atoms, most typically 1 to 3 carbon atoms. In a preferred form the sulfinic acid radical includes an aromatic residue. A preferred substituent can be represented by the following:

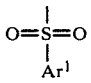

(III)

wherein $Ar^1$ is an aryl group. In a specifically preferred form of the invention $Ar^1$ is a carbocyclic aromatic ring containing from 6 to 10 carbon atoms (e.g., phenyl or naphthyl) which can optionally be substituted. While either electron withdrawing or electron donating substituents can be employed, highly electron donating substituents are not preferred. Substituents discussed below, typically contain up to 8 carbon atoms.

A particularly preferred class of phenylhydrazides are acylhydrazinophenylthioureas represented by formula (IV) below.

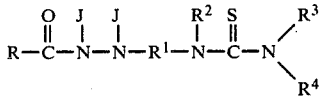

(IV)

wherein

J is as defined above;

R is hydrogen or an alkyl, cycloalkyl, haloalkyl, alkoxyalkyl, or phenylalkyl substituent or a phenyl nucleus having a Hammett sigma-value-derived electron-withdrawing characteristic more positive than −0.30;

$R^1$ is a phenylene or alkyl, halo-, or alkoxy-substituted phenylene group;

$R^2$ is hydrogen, benzyl, alkoxybenzyl, halobenzyl, or alkylbenzyl;

$R^3$ is a alkyl, haloalkyl, alkoxyalkyl, or phenylalkyl substituent having from 1 to 18 carbon atoms, a cycloalkyl substituent, a phenyl nucleus having a Hammett sigma value-derived electron-withdrawing characteristic less positive than +0.50, or naphthyl, $R^4$ is hydrogen or independently selected from among the same substituents as $R^3$; or $R^3$ and $R^4$ together form a heterocyclic nucleus forming a 5- or 6-membered ring, wherein the ring atoms are chosen from the class consisting of nitrogen, carbon, oxygen, sulfur, and selenium atoms;

with the proviso that at least one of $R^2$ and $R^4$ must be hydrogen and the alkyl moieties, except as otherwise noted, in each instance include from 1 to 6 carbon atoms and the cycloalkyl moieties have from 3 to 10 carbon atoms.

As indicated by R in formula (IV), preferred acylhydrazinophenylthioureas employed in the practice of this invention contain an acyl group which is the residue of a carboxylic acid, such as one of the acyclic carboxylic acids, including formic acid, acetic acid, propionic acid, butyric acid, higher homologues of these acids having up to about 7 carbon atoms, and halogen, alkoxy, phenyl and equivalent substituted derivatives thereof. In a preferred form, the acyl group is formed by an unsubstituted acyclic aliphatic carboxylic acid having from 1 to 5 carbon atoms. Specifically preferred acyl groups are formyl and acetyl. As between compounds which differ solely in terms of having a formyl or an acetyl group, the compound containing the formyl group exhibits higher nucleating agent activity. The alkyl moieties in the substituents to the carboxylic acids are contemplated to have from 1 to 6 carbon atoms, preferably from 1 to 4 carbon atoms.

In addition to the acyclic aliphatic carboxylic acids, it is recognized that the carboxylic acid can be chosen so that R is a cyclic aliphatic group having from about 3 to 10 carbon atoms, such as, cyclopropyl, cyclobutyl, cyclopentyl, cyclohexyl, methylcyclohexyl, cyclooctyl, cyclodecyl, and bridged ring variations, such as, bornyl and isobornyl groups. Cyclohexyl is a specifically preferred cycloalkyl substituent. The use of alkoxy, cyano, halogen, and equivalent substituted cycloalkyl substituents is contemplated.

As indicated by $R^1$ in formula (IV), preferred acylhydrazinophenylthioureas employed in the practice of this invention contain a phenylene or substituted phenylene group. Specifically preferred phenylene groups are m- and p-phenylene groups. Exemplary of preferred phenylene substituents are alkoxy substituents having from 1 to 6 carbon atoms, alkyl substituents having from 1 to 6 carbon atoms, fluoro-, chloro-, bromo-, and iodo-substituents. Unsubstituted p-phenylene groups are specifically preferred. Specifically preferred alkyl moieties are those which have from 1 to 4 carbon atoms. While phenylene and substituted phenylene groups are preferred linking groups, other functionally equivalent divalent aryl groups, such as naphthalene groups, can be employed.

In one form $R^2$ represents an unsubstituted benzyl group or substituted equivalents thereof, such as alkyl, halo-, or alkoxy-substituted benzyl groups. In the preferred form no more than 6 and, most preferably, no more than 4 carbon atoms are contributed by substituents to the benzyl group. Substituents to the benzyl group are preferably para-substituents. Specifically preferred benzyl substituents are formed by unsubstituted, 4-halo-substituted, 4-methoxy-substituted, and 4-methyl-substituted benzyl groups. In another specifically preferred form $R^2$ represents hydrogen.

Referring again to formula (IV), it is apparent that $R^3$ and $R^4$ can independently take a variety of forms. One specifically contemplated form can be an alkyl group or a substituted alkyl group, such as a haloalkyl group, alkoxyalkyl group, phenylalkyl group, or equivalent group, having a total of up to 18, preferably up to 12, carbon atoms. Specifically $R^3$ and/or $R^4$ can take the form of a methyl, ethyl, propyl, butyl, pentyl, hexyl, heptyl, octyl, nonyl, decyl or higher homologue group having up to 18 total carbon atoms; a fluoro-, chloro-, bromo-, or iodo-substituted derivative thereof; a methoxy, ethoxy, propoxy, butoxy or higher homologue alkoxy-substituted derivative thereof, wherein the total number of carbon atoms are necessarily at least 2 up to 18; and a phenyl-substituted derivative thereof, wherein the total number of carbon atoms is necessarily at least 7, as in the case of benzyl, up to about 18. In a specific preferred form $R^3$ and/or $R^4$ can take the form of an alkyl or phenylalkyl substituent, wherein the alkyl moieties are in each instance from 1 to 6 carbon atoms.

In addition to the acyclic aliphatic and aromatic forms discussed above, it is also contemplated that $R^3$ and/or $R^4$ can take the form of a cyclic aliphatic substituent, such as a cycloalkyl substituent having from 3 to 10 carbon atoms. The use of cyclopropyl, cyclobutyl, cyclopentyl, cyclohexyl, methylcyclohexyl, cyclooctyl, cyclodecyl, and bridged ring variations, such as, bornyl and isobornyl groups, is contemplated. Cyclohexyl is a preferred cycloalkyl substituent. The use of alkoxy, cyano, halogen, and equivalent substituted cycloalkyl substituents is contemplated.

$R^3$ and/or $R^4$ can also be an aromatic substituent, such as, phenyl or naphthyl (i.e., 1-naphthyl or 2-naphthyl) or an equivalent aromatic group, e.g., 1-, 2-, or 9-anthryl, etc. As indicated in formula (IV) $R^3$ and/or $R^4$ can take the form of a phenyl nucleus which is either electron-donating or electron-withdrawing, however phenyl nuclei which are highly electron-withdrawing may produce inferior nucleating agents.

The electron-withdrawing or electron-donating characteristic of a specific phenyl nucleus can be assessed by reference to Hammett sigma values. The phenyl nucleus can be assigned a Hammett sigma value-derived electron-withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron-withdrawing substituents are assigned positive sigma values, while electron-donating substituents are assigned negative sigma values.

Exemplary meta- and para-sigma values and procedures for their determination are set forth by J. Hine in *Physical Organic Chemistry,* second edition, page 87, published in 1962, H. VanBekkum, P. E. Verkade and B. M. Wepster in *Rec. Trav. Chim.,* Volume 78, page 815, published in 1959, P. R. Wells in *Chem. Revs.,* Volume 63, page 171, published in 1963, by H. H. Jaffe in *Chem. Revs.,* Volume 53, page 191, published in 1953, by M. J. S. Dewar and P. J. Grisdale in *J. Amer. Chem. Soc.,* Volume 84, page 3548, published in 1962, and by Barlin and Perrin in *Quart. Revs.,* Volume 20, page 75 et seq, published in 1966. For the purposes of this invention, ortho-substituents to the phenyl ring can be assigned to the published para-sigma values.

It is preferred that $R^2$ and/or $R^3$ be a phenyl nucleus having a Hammett sigma value-derived electron-withdrawing characteristic less positive than +0.50. It is specifically contemplated that $R^2$ and/or $R^3$ be chosen from among phenyl nuclei having cyano, fluoro-, chloro-, bromo-, iodo-, alkyl groups having from 1 to 6 carbon atoms, and alkoxy groups having from 1 to 6 carbon atoms, as phenyl ring substituents. Phenyl ring substituents are preferred in the para- or 4-ring position.

Rather than being independently chosen $R^2$ and $R^3$ can together form, along with the 3-position nitrogen atom of the thiourea, a heterocyclic nucleus forming a 5- or 6-membered ring. The ring atoms can be chosen from among nitrogen, carbon, oxygen, sulfur and selenium atoms. The ring necessarily contains at least one nitrogen atom. Exemplary rings include morpholino, piperidino, pyrrolidinyl, pyrrolinyl, thiomorpholino, thiazolidinyl, 4-thiazolinyl, selenazolidinyl, 4-selenazolinyl, imidazolidinyl, imidazolinyl, oxazolidinyl, and 4-oxazolinyl rings. Specifically preferred rings are saturated or otherwise constructed to avoid electron withdrawal from the 3-position nitrogen atom.

Acylhydrazinophenylthiourea nucleating agents and their synthesis are more specifically disclosed in Leone U.S. Pat. Nos. 4,030,925 and 4,276,364, here incorporated by reference. Variants of the acylhydrazinophenylthiourea nucleating agents described above are disclosed in von Konig U.S. Pat. No. 4,139,387 and Adachi et al U.K. patent application No. 2,012,443A.

Another preferred class of phenylhydrazide nucleating agents are N-(acylhydrazinophenyl)thioamide nucleating agents, such as those indicated by formula (V) below:

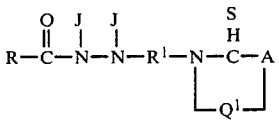

(V)

wherein

R, $R^1$, and J are as defined in formula (IV);

A is $=N-R^2$, —S— or —O—;

$Q^1$ represents the atoms necessary to complete a five-membered heterocyclic nucleus;

$R^2$ is independently chosen from hydrogen, phenyl, alkyl, alkylphenyl, and phenylalkyl; and the alkyl moieties in each instance include from 1 to 6 carbon atoms.

These compounds embrace those having a five-membered heterocyclic thioamide nucleus, such as a 4-thiazoline-2-thione, thiazolidine-2-thione, 4-oxazoline-2-thione, oxazolidine-2-thione, 2-pyrazoline-5-thione, pyrazolidine-5-thione, indoline-2-thione, and 4-imidazoline-2-thione, etc. A specifically preferred subclass of heterocyclic thioamide nuclei is formed when $Q^1$ is as indicated in formula (VI)

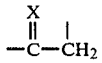

(VI)

wherein

X is =S or =0. Specifically preferred illustrations of such values of $Q^1$ are 2-thiohydantoin, rhodanine, isorhodanine, and 2-thio-2,4-oxazolidinedione nuclei. It is believed that some six-membered nuclei, such as thiobarbituric acid, may be equivalent to five-membered nuclei embraced within formula (V).

Another specifically preferred subclass of heterocyclic thioamide nuclei is formed when $Q^1$ is as indicated in formula (VII)

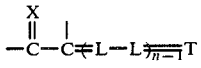

(VII)

wherein

L is a methine group;

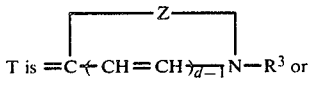

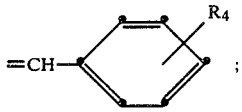

$R^3$ is an alkyl substituent;

$R^4$ is hydrogen; an alkyl,

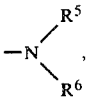

or an alkoxy substituent;

Z represents the nonmetallic atoms necessary to complete a basic heterocyclic nucleus of the type found in cyanine dyes;

n and d are independently chosen from the integers 1 and 2;

$R^5$ and $R^6$ are independently chosen from hydrogen, phenyl, alkyl, alkylphenyl, and phenylalkyl; and the alkyl moieties in each instance include from 1 to 6 carbon atoms.

The formula (VII) values for $Q^1$ provide a heterocyclic thioamide nucleus corresponding to a methine substituted form of the nuclei present above in formula (VI) values for $Q^1$. In a specifically preferred form the heterocyclic thioamide nucleus is preferably a methine substituted 2-thiohydantoin, rhodanine, isorhodanine, or 2-thio-2,4-oxazolidinedione nucleus. The heterocyclic thioamide nucleus of formula (VII) is directly, or through an intermediate methine linkage, substituted with a basic heterocyclic nucleus of the type employed in cyanine dyes or a substituted benzylidene nuclues. Z preferably represents the nonmetallic atoms necessary to complete a basic 5- or 6-membered heterocyclic nucleus of the type found in cyanine dyes having ring-forming atoms chosen from the class consisting of carbon, nitrogen, oxygen, sulfur, and selenium.

N-(acylhydrazinophenyl)thioamide nucleating agents and their synthesis are more specifically disclosed in Leone et al U.S. Pat. No. 4,080,207.

Still another preferred class of phenylhydrazide nucleating agents are triazole-substituted phenylhydrazide nucleating agents. More specifically, preferred triazole-substituted phenylhydrazide nucleating agents are those represented by formula (VIII) below:

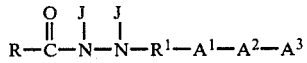

(VIII)

wherein

R, $R^1$, and J are as defined in formula (II);

$A^1$ is alkylene or oxalkylene;

$A^2$ is

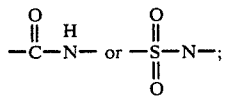

and $A^3$ is a triazolyl or benzotriazolyl nucleus;

the alkyl and alkylene moieties in each instance including from 1 to 6 carbon atoms.

Still more specifically preferred triazole-substituted phenylhydrazide nucleating agents are those represented by formula (IX) below:

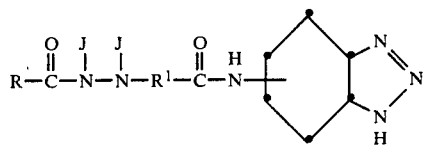

(IX)

wherein

J is as defined above;

R is hydrogen or methyl;

$R^1$ is

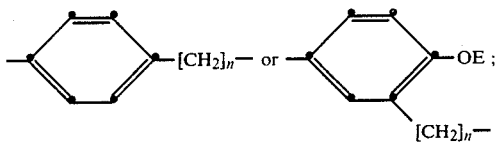

n is an integer of 1 to 4; and

E is alkyl of from 1 to 4 carbon atoms.

Triazole-substituted phenylhydrazide nucleating agents and their synthesis are disclosed by Sidhu et al U.S. Pat. No. 4,278,748, here incorporated by reference. Comparable nucleating agents having a somewhat broader range of adsorption promoting groups are disclosed in corresponding U.K. patent application No. 2,011,391A.

The aromatic hydrazides represented by formulas (IV), (V), and (VII) each contain adsorption promoting substituents. In many instances it is preferred to employ in combination with these aromatic hydrazides additional hydrazides or hydrazones which do not contain substituents specifically intended to promote adsorption to silver halide grain surfaces. Such hydrazides or hydrazones, however, often contain substituents to reduce their mobility when incorporated in photographic elements. These hydrazide or hydrazones can be employed as the sole nucleating agent, if desired.

Such hydrazides and hydrazones include those represented by formula (X) and (XI) below:

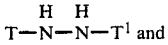

(X)

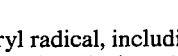

(IX)

wherein T is an aryl radical, including a substituted aryl radical, $T^1$ is an acyl radical, and $T^2$ is an alkylidene radical and including substituted alkylidene radicals. Typical aryl radicals for the substituent T have the formula $M\text{-}T^3\text{-}$, wherein $T^3$ is an aryl radical (such as, phenyl, 1-naphthyl, 2-naphthyl, etc.) and M can be such substituents as hydrogen, hydroxy, amino, alkyl, alkylamino, arylamino, heterocyclic amino (amino containing a heterocyclic moiety), alkoxy, aryloxy, acyloxy, arylcarbonamido, alkylcarbonamido, heterocyclic carbonamido (carbonamido containing a heterocyclic moiety), arylsulfonamido, alkylsulfonamido, and heterocyclic sulfonamido (sulfonamido containing a heterocyclic moiety). Typical acyl radicals for the substituent $T^1$ have the formula

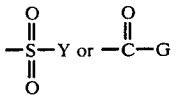

wherein Y can be such substituents as alkyl, aryl, and heterocyclic radicals, G can represent a hydrogen atom or the same substituent as Y as well as radicals having the formula

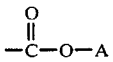

to form oxalyl radicals wherein A is an alkyl, aryl, or a heterocyclic radical. Typical alkylidene radicals for the substituent $T^2$ have the formula =CH-D wherein D can be a hydrogen atom or such radicals as alkyl, aryl, and heterocyclic radicals. Typical aryl substituents for the above-described hydrazides and hydrazones include phenyl, naphthyl, diphenyl, and the like. Typical heterocyclic substituents for the above-described hydrazides and hydrazones include azoles, azines, furan, thiophene, quinoline, pyrazole, and the like. Typical alkyl (or alkylidene) substituents for the above-described hydrazides and hydrazones have 1 to 22 carbon atoms including methyl, ethyl, isopropyl, n-propyl, isobutyl, n-butyl, t-butyl, amyl, n-octyl, n-decyl, n-dodecyl, n-octadecyl, n-eicosyl, and n-docosyl.

The hydrazides and hydrazones represented by formulas (X) and (XI) as well as their synthesis are disclosed by Whitmore U.S. Pat. No. 3,227,552, here incorporated by reference.

Still other useful hydrazine and hydrazide nucleating agents are disclosed in *Research Disclosure,* Vol. 235, November, 1983, Item 23510, here incorporated by reference.

A secondary preferred general class of nucleating agents for use in the practice of this invention are N-substituted cycloammonium quaternary salts. A particularly preferred species of such nucleating agents is represented by formula (XII) below:

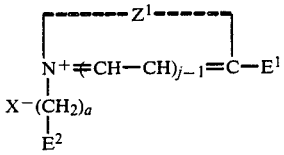

(XII)

wherein $Z^1$ represents the atoms necessary to complete a heterocyclic nucleus containing a heterocyclic ring of 5 to 6 atoms including the quaternary nitrogen atoms, with the additional atoms of said heterocyclic ring being selected from carbon, nitrogen, oxygen, sulfur, and selenium;

j represents a positive integer of from 1 to 2;

a represents a positive integer of from 2 to 6;

$X^-$ represents an acid anion;

$E^2$ represents a member selected from (a) a formyl radical, (b) a radical having the formula

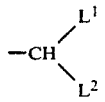

wherein each of $L^1$ and $L^2$, when taken alone, represents a member selected from an alkoxy radical and an alkylthio radical, and $L^1$ and $L^2$, when taken together, represent the atoms necessary to complete a cyclic radical selected from cyclic oxyacetals and cyclic thioacetals having from 5 to 6 atoms in the heterocyclic acetal ring, and (c) a 1-hydrazonoalky radical; and $E^1$ represents either a hydrogen atom, an alkyl radical, an aralkyl radical, an alkylthio radical, or an aryl radical such as phenyl and naphthyl, and including substituted aryl radicals.

The N-substituted cycloammonium quaternary salt nucleating agents of formula (XII) and their synthesis are disclosed by Lincoln and Heseltine U.S. Pat. Nos. 3,615,615 and 3,759,901. In a variant form $E^1$ can be a divalent alkylene group of from 2 to 4 carbon atoms joining two substituted heterocyclic nuclei as shown in formula (XII). Such nucleating agents and their synthesis are disclosed by Kurtz and Harbison U.S. Pat. No. 3,734,738.

The substituent to the quaternized nitrogen atom of the heterocyclic ring can, in another variant form, itself form a fused ring with the heterocyclic ring. Such nucleating agents are illustrated by dihydroaromatic quaternary salts comprising a 1,2-dihydroaromatic heterocyclic nucleus including a quaternary nitrogen atom. Particularly advantageous 1,2-dihydroaromatic nuclei include such nuclei as a 1,2-dihydropyridinium nucleus. Especially preferred dihydroaromatic quaternary salt nucleating agents include those represented by formula (XIII) below:

(XIII)

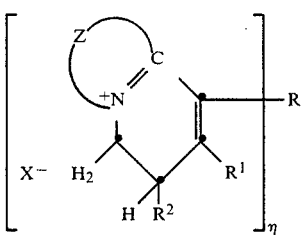

wherein

Z represents the nonmetallic atoms necessary to complete a heterocyclic nucleus containing a heterocyclic ring of from 5 to 6 atoms including the quaternary nitrogen atom, with the additional atoms of said heterocyclic ring being selected from either carbon, nitrogen, oxygen, sulfur, or selenium;

n represents a positive integer having a value of from 1 to 2;

when n is 1, R represents a member selected from the group consisting of a hydrogen atom, an alkyl radical, an alkoxy radical, an aryl radical, an aryloxy radical, and a carbamido radical and, when n is 2, R represents an alkylene radical having from 1 to 4 carbon atoms;

each of $R^1$ and $R^2$ represents a member selected from the group consisting of a hydrogen atom, an alkyl radical, and an aryl radical; and $X^-$ represents an anion.

Dihydroaromatic quaternary salt nucleating agents and their synthesis are disclosed by Kurtz and Heseltine U.S. Pat. No. 3,719,494, here incorporated by reference.

A specifically preferred class of N-substituted cycloammonium quaternary salt nucleating agents are those which include one or more alkynyl substituents. Such nucleating agents include compounds within the generic structural definition set forth in formula (XIV) below:

(XIV)

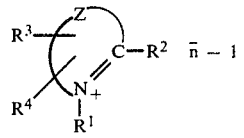

wherein Z represents an atomic group necessary for forming a 5- or 6-membered heterocyclic nucleus, $R^1$ represents an aliphatic group, $R^2$ represents a hydrogen atom or an aliphatic group, $R^3$ and $R^4$, which may be the same or different, each represents a hydrogen atom, a halogen atom, an aliphatic group, an alkoxy group, a hydroxy group, or an aromatic group, at least one of $R^1$, $R^2$, $R^3$ and $R^4$ being a propargyl group, a butynyl group, or a substituent containing a propargyl or butynyl group, $X^-$ represents an anion, n is 1 or 2, with n being 1 when the compound forms an inner salt.

Such alkynyl-substituted cycloammonium quaternary salt nucleating agents and their synthesis are illustrated by Adachi et al U.S. Pat. No. 4,115,122, here incorporated by reference. Ballasted nucleating agents of the type shown in formula (XIV) are disclosed in *Research Disclosure,* Vol. 232, August 1983, Item 23213, and nucleating agents of the type shown in formula (XIV) containing an adsorption promoting group are disclosed by Parton et al U.S. Pat. No. 4,471,044, both here incorporated by reference.

The specific choice of nucleating agents can be influenced by a variety of factors. The nucleating agents of Leone U.S. Pat. Nos. 4,030,925 and 4,276,364, cited above are particularly preferred for many applications, since they are effective at very low concentrations. Minimum concentrations as low as 0.1 mg of nucleating agent per mole of silver, preferably at least 0.5 mg per silver mole, and optimally at least 1 mg per silver mole are disclosed. These nucleating agents are particularly advantageous in reducing speed loss and in some instances permitting speed gain with increasing processing temperatures.

The aromatic hydrazide nucleating agents are generally preferred for use in photographic elements intended to be processed at comparatively high levels of pH, typically above 13. The alkynyl-substituted cycloammonium quaternary salt nucleating agents are particularly useful for processing at a pH of 13 or less. Adachi et al U.S. Pat. No. 4,115,122 teaches these nucleating agents to be useful in processing within the pH range of from 10 to 13, preferably 11 to 12.5. In addition to the nucleating agents described above additional nucleating agents have been identified which are useful in processing at pH levels in the range of from about 10 to 13, such as N-substituted cycloammonium quaternary salt nucleating agents of the type disclosed by Baralle et al U.S. Pat. No. 4,306,016, here incorporated by reference; dihydrospiropyran bis-condensation products of salicylic aldehyde and at least one heterocyclic ammonium salt of the type disclosed by Baralle et al U.S. Pat. No. 4,306,017, here incorporated by reference; and diphenylmethane nucleating agents of the type disclosed by Baralle et al U.S. Pat. No. 4,315,986, here incorporated by reference.

Instead of being incorporated in the photographic element during manufacture, nucleating agents can alternatively or additionally be incorporated in the developer solution. Hydrazine ($H_2N—NH_2$) is an effective nucleating agent which can be incorporated in the developing solution. As an alternative to the use of hydrazine, any of a wide variety of water-soluble hydrazine derivatives can be added to the developing solution. Preferred hydrazine derivatives for use in developing solutions include organic hydrazine compounds of the formula:

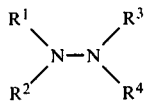

(XV)

where $R^1$ is an organic radical and each of $R^2$, $R^3$ and $R^4$ is a hydrogen atom or an organic radical. Organic radicals represented by $R^1$, $R^2$, $R^3$ and $R^4$ include hydrocarbyl groups such as an alkyl group, an aryl group, an aralkyl group, an alkaryl group, and an alicyclic group, as well as hydrocarbyl groups substituted with substituents such as alkoxy groups, carboxy groups, sulfonamido groups, and halogen atoms.

Particularly preferred hydrazine derivatives for incorporation in developing solutions include alkylsulfonamidoarylhydrazines, such as p-(methylsulfonamido)phenylhydrazine, and alkylsulfonamidoalkylaryl hydrazines, such as p-(methylsulfonamidomethyl)phenylhydrazine.

The hydrazine and hydrazide derivatives described above are disclosed in Smith et al U.S. Pat. No. 2,410,690, Stauffer et al U.S. Pat. No. 2,419,975, and Hunsberger U.S. Pat. No. 2,892,715. The preferred hydrazines for incorporation in developers are described in Nothnagle U.S. Pat. No. 4,269,929. Another preferred class of nucleating agents that can be incorporated in the developer correspond to formula (I) above, but with the moiety M capable of restricting mobility absent. Nucleating agents of this type are disclosed in Okutsu et al U.S. Pat. No. 4,221,857 and Takada et al U.S. Pat. No. 4,224,401.

Once internal latent image forming emulsions have been generated by precipitation procedures, washed, and sensitized, as described above, their preparation can be completed by the optional incorporation of nucleating agents, described above, and conventional photographic addenda, and they can be usefully applied to photographic applications requiring a silver image to be produced—e.g., conventional black and white photography.

The internal latent image forming emulsion is comprised of a dispersing medium in which the grains are dispersed. The dispersing medium of the emulsion layers and other layers of the photographic elements, including the antifoggant undercoat, can contain various colloids alone or in combination as vehicles (which include both binders and peptizers). Preferred peptizers are hydrophilic colloids, which can be employed alone or in combination with hydrophobic materials. Preferred peptizers are gelatin—e.g., alkali-treated gelatin (cattle bone or hide gelatin) and acid-treated gelatin (pigskin gelatin) and gelatin derivatives—e.g., acetylated gelatin, phthalated gelatin, and the like. Useful vehicles are illustrated by those disclosed in *Research Disclosure,* Item 176643, cited above, Section IX, here incorporated by reference. The layers of the photographic elements containing crosslinkable colloids, particularly the gelatin-containing layers, can be hardened by various organic and inorganic hardeners, as illustrated by *Research Disclosure,* Item 17643, cited above, Section X.

In addition to the maximum density enhancing antifoggants in the undercoat described above, other antifoggants and stabilizers known to be useful in combination with internal latent desensitization direct positive imaging can be incorporated in the photographic elements of this invention at any useful location. A variety of such addenda are disclosed in *Research Disclosure,* Item 17643, cited above, Section VI. Many of the antifoggants which are effective in emulsions can also be used in developers and can be classified under a few general headings, as illustrated by C.E.K. Mees, *The Theory of the Photographic Process,* 2nd Ed., Macmillan, 1954, pp. 677–680.

In addition to sensitizers, hardeners, and antifoggants and stabilizers, a variety of other conventional photographic addenda can be present. The specific choice of addenda depends upon the exact nature of the photographic application and is well within the capability of the art. A variety of useful addenda are disclosed in *Research Disclosure,* Item 17643, cited above, here incorporated by reference. Optical brighteners can be introduced, as disclosed by Item 17643 at Section V. Absorbing and scattering materials can be employed in the emulsions of the invention and in separate layers of the photographic elements, as described in Section VIII. Coating aids, as described in Section XI, and plasticizers and lubricants, as described in Section XII, can be present. Antistatic layers, as described in Section XIII, can be present. Methods of addition of addenda are described in Section XIV. Matting agents can be incorporated, as described in Section XVI. Developing agents and development modifiers can, if desired, be incorporated, as described in Sections XX and XXI. The silver halide emulsion layer or layers, antifoggant undercoat, as well as optional interlayers, overcoats, and subbing layers, if any, present in the photographic elements can be coated and dried as described in Item 17643, Section XV.

The layers of the photographic elements can be coated on a variety of supports. Typical photographic supports include polymeric film, wood fiber—e.g., paper, metallic sheet and foil, glass, and ceramic supporting elements provided with one or more subbing layers to enhance the adhesive, antistatic, dimensional, abrasive, hardness, frictional, antihalation and/or other properties of the support surface. Suitable photographic supports are illustrated by *Research Disclosure,* Item 17643, cited above, Section XVII, here incorporated by reference.

Although the emulsion layer or layers are typically coated as continuous layers on supports having opposed planar major surfaces, this need not be the case. The emulsion layers can be coated as laterally displaced layer segments on a planar support surface. When the emulsion layer or layers are segmented, it is preferred to employ a microcellular support. Useful microcellular supports are disclosed by Whitmore Patent Cooperation Treaty published application No. WO80/01614, published Aug. 7, 1980, (Belgian Pat. No. 881,513, Aug. 1, 1980, corresponding), here incorporated by reference. Microcells can range from 1 to 200 microns in width and up to 1000 microns in depth. It is generally preferred that the microcells be at least 4 microns in width and less than 200 microns in depth, with optimum dimensions being about 10 to 100 microns in width and depth for ordinary black and white imaging applications—particularly where the photographic image is intended to be enlarged.

The photographic elements of the present invention can be imagewise exposed in any conventional manner. Attention is directed to *Research Disclosure* Item 17643, cited above, Section XVIII, here incorporated by reference. The present invention is particularly advantageous when imagewise exposure is undertaken with electromagnetic radiation within the region of the spectrum in which the spectral sensitizers present exhibit absorption maxima. When the photographic elements are intended to record blue, green, red, or infrared exposures, spectral sensitizer absorbing in the blue, green, red, or infrared portion of the spectrum is present. As noted above, for black and white imaging applications it is preferred that the photographic elements be orthochromatically or panchromatically sensitized to permit light to extend sensitivity within the visible spectrum. Radiant energy employed for exposure can be either noncoherent (random phase) or coherent (in phase), produced by lasers. Imagewise exposures at ambient, elevated, or reduced temperatures and/or pressures, including high or low intensity exposures, continuous or intermittent exposures, exposure times ranging from minutes to relatively short durations in the millisecond to microsecond range, can be employed within the useful response ranges determined by conventional sensitometric techniques, as illustrated by T. H. James, *The Theory of the Photographic Process,* 4th Ed., Macmillan, 1977, Chapters 4, 6, 17, 18, and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry,* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography Materials, Processes and Systems,* VanNostrand Reinhold Company, 7th Ed., 1977.

Included among the processing methods are web processing, as illustrated by Tregillus et al U.S. Pat. No. 3,179,517; stabilization processing, as illustrated by Herz et al U.S. Pat. No. 3,220,839, Cole U.S. Pat. No. 3,615,511, Shipton et al U.K. Pat. No. 1,258,906 and Haist et al U.S. Pat. No. 3,647,453; monobath processing as described in Haist, *Monobath Manual,* Morgan and Morgan, Inc., 1966, Schuler U.S. Pat. No. 3,240,603, Haist et al U.S. Pat. Nos. 3,615,513 and 3,628,955 and Price U.S. Pat. No. 3,723,126; infectious development, as illustrated by Milton U.S. Pat. Nos. 3,294,537, 3,600,174, 3,615,519 and 3,615,524, Whiteley U.S. Pat. No. 3,516,830, Drago U.S. Pat. No. 3,615,488, Salesin et al U.S. Pat. No. 3,625,689, Illingsworth U.S. Pat. No. 3,632,340, Salesin U.K. Pat. No. 1,273,030 and U.S. Pat. No. 3,708,303; hardening development, as illustrated by Allen et al U.S. Pat. No. 3,232,761; roller transport processing, as illustrated by Russell et al U.S. Pat. Nos. 3,025,779 and 3,515,556, Masseth U.S. Pat. No. 3,573,914, Taber et al U.S. Pat. No. 3,647,459 and Rees et al U.K. Pat. No. 1,269,268; alkaline vapor processing, as illustrated by *Product Licensing Index,* Vol. 97, May 1972, Item 9711, Goffe et al U.S. Pat. No. 3,816,136 and King U.S. Pat. No. 3,985,564; metal ion development as illustrated by Price, *Photographic Science and Engineering,* Vol. 19, Number 5, 1975, pp. 283–287 and Vought *Research Disclosure,* Vol. 150, October 1976, Item 15034; and surface application processing, as illustrated by Kitze U.S. Pat. No. 3,418,132.

Although development is preferably undertaken in the presence of a nucleating agent, as described above, giving the photographic elements an over-all light exposure either immediately prior to or, preferably, during development can be undertaken as an alternative. When an over-all flash exposure is used, it can be of high intensity and short duration or of lower intensity for a longer duration.

The silver halide developers employed in processing are surface developers. It is understood that the term "surface developer" encompasses those developers which will reveal the surface latent image centers on a silver halide grain, but will not reveal substantial internal latent image centers in an internal latent image forming emulsion under the conditions generally used to develop a surface sensitive silver halide emulsion. The surface developers can generally utilize any of the silver halide developing agents or reducing agents, but the developing bath or composition is generally substantially free of a silver halide solvent (such as water soluble thiocyanates, water soluble thioethers, thiosulfates, and ammonia) which will disrupt or dissolve the grain to reveal substantial internal image. Low amounts of excess halide are sometimes desirable in the developer or incorporated in the emulsion as halide releasing compounds, but high amounts of iodide or iodide releasing compounds are generally avoided to prevent substantial disruption of the grain.

Typical silver halide developing agents which can be used in the developing compositions of this invention include hydroquinones, catechols, aminophenols, 3-pyrazolidinones, ascorbic acid and its derivatives, reductones, phenylenediamines, or combinations thereof. The developing agents can be incorporated in the photographic elements wherein they are brought into contact with the silver halide after imagewise exposure; however, in certain embodiments they are preferably employed in the developing bath.

Once a silver image has been formed in the photographic element, it is conventional practice to fix the undeveloped silver halide. The high aspect ratio tabular grain emulsions are particularly advantageous in allowing fixing to be accomplished in a shorter time period. This allows processing to be accelerated.

Except as otherwise stated, the remaining features of the black and white direct positive photographic elements of this invention and the production of direct positive images by processing these photographic elements after imagewise exposure should be understood to contain features recognized in the art for such photographic applications.

EXAMPLES

The invention can be better appreciated by reference to the following specific examples:

EXAMPLE 1

I. Coatings

A. Control Coating

A 0.8 μm octahedral core-shell AgBr emulsion was prepared by a double jet precipitation technique. The core grains consisted of a 0.55 μm octahedral AgBr chemically sensitized with 0.78 mg $Na_2S_2O_3.5H_2O$/mole Ag and 1.18 mg $KAuCl_4$/mole Ag for 30 minutes at 85° C. The core-shell emulsion was chemically sensitized with 1.0 mg $Na_2S_2O_3.5H_2O$/mole Ag for 30 minutes at 74° C. The emulsion was coated on a polyester film support at 7.02 g/m$^2$ silver and 4.86 g/m$^2$ gelatin. The emulsion layer also contained the spectral sensitizing dyes anhydro-5,5'-dimethoxy-3,3'-bis(3-sulfopropyl)selenacyanine hydroxide, sodium salt (Dye A) and anhydro-5,5'-dichloro-3,9-diethyl-3'-(3-sulfopropyl)oxacarbocyanine hydroxide (Dye B) each at 200 mg/mole Ag and the nucleating agent 6-ethoxythiocarbamoyl-2-methyl-1-propargylquinolinium trifluoromethanesulfonate at 30 mg/mole Ag. The element was overcoated with gelatin at 1.08 g/m$^2$ containing 1.7% bis(vinylsulfonylmethyl) ether by weight based on total gel content.

B. Example Coating

The control coating was again prepared, but with $1.8\times10^{-2}$ mole of AF-3 per silver mole and gelatin (1.29 g/m$^2$) in an antifoggant undercoat between the emulsion layer and the support.

II. Processing

A. Control Coating: An exposed portion of the control coating was processed for 75 seconds at 38° C. in Developer I, the developer additionally containing 0.10 gram of AF-3 and 0.16 gram of 1-phenyl-5-mercaptotetrazole (hereinafter PMT) per liter.

B. Example Coating: An exposed portion of the example coating was processed for 75 seconds at 38° C. in Developer I, the developer additionally containing 0.15 gram of AF-3 and 0.11 gram of PMT per liter.

III. Sensitometry

Figure 2:
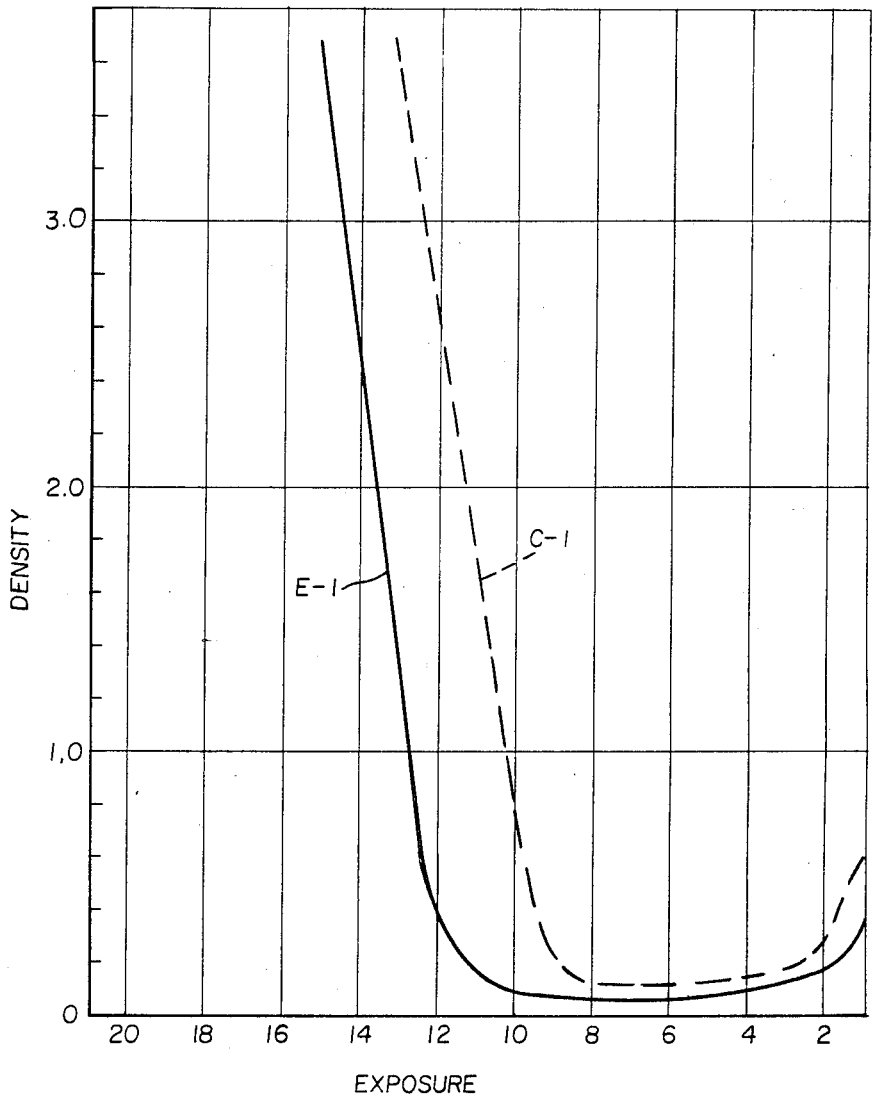
FIGS. 2, 6, and 7 present characteristic curves of example and coated emulsions.

Sensitometric results are shown in FIG. 2 and Table II.

TABLE II

| | Sensitometric Results | | | | |
|---|---|---|---|---|---|
| | Relative | | Developed | | |
| Coating | Log Speed* | Contrast | D-max | Ag g/m$^2$ | D-min |
| Control (C-1) | 236 | 6.3 | 4.4 | 7.21 | 0.11 |
| Example (E-1) | 273 | 8.9 | 6.2 | 6.89 | 0.06 |

*Speed taken at 0.2 density + D-min for an exposure of $10^{-5}$ second through a 0–3.0 density step tablet (0.15 density steps) plus a 0.86 neutral density filter and with a filter to simulate a phosphor emitting at a wavelength maximumof 465 nm, log speed = 100(1-log E).

As the results show, the effect of AF-3 in the undercoat was to increase speed, contrast, and D-max and to decrease D-min over the control. Since higher D-max was obtained at lower developed Ag, the covering power of the silver developed was greater for the invention. Also the example coating shows a greater exposure separation between the positive image and the rereversal negative image than in the control coating, as can be seen in FIG. 2.

IV. Image Quality

Figure 3A:
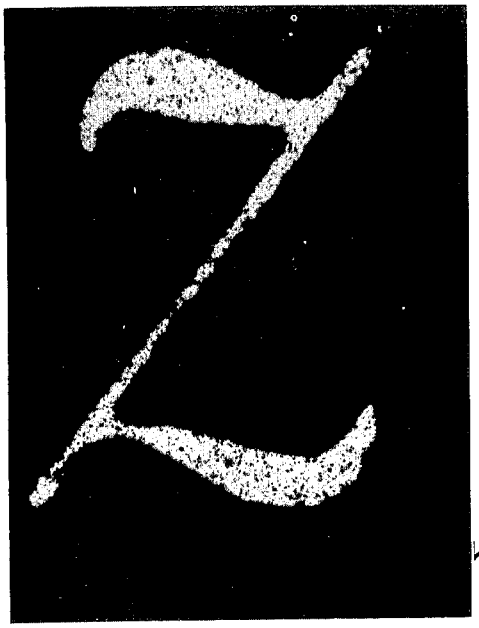
Figure 3B:
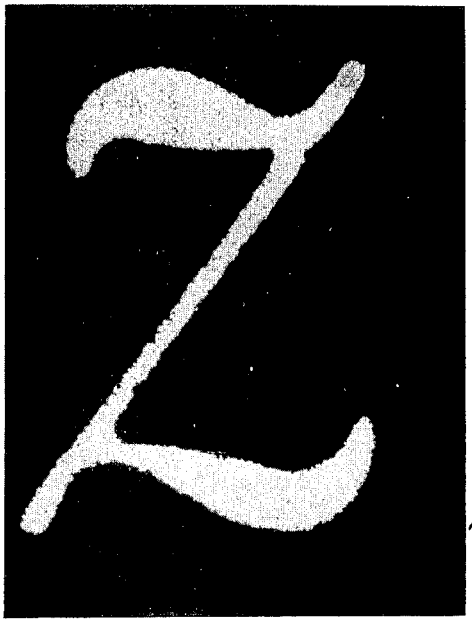
Figure 4A:
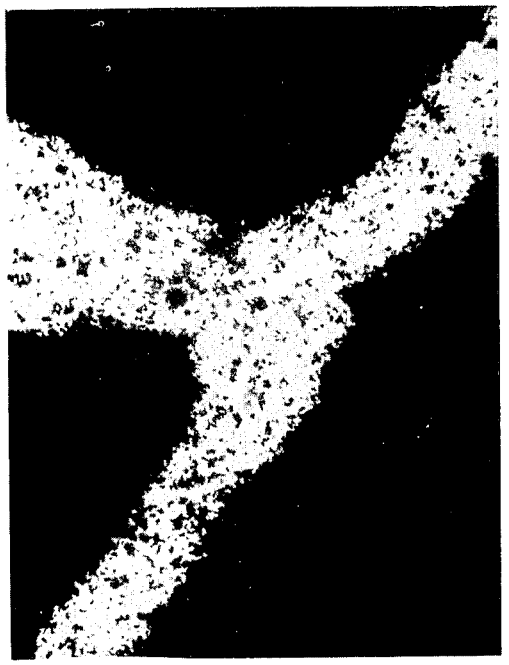
Figure 4B:
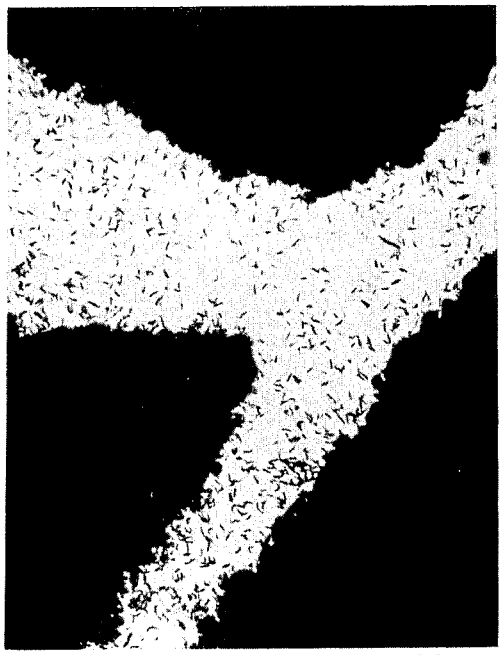

Portions of the coatings were exposed similarly to those above, but through a microimage target in place of the step tablet, and an estimation of the image quality was deduced. FIG. 3A shows the results of exposing the control coating at an exposure equivalent to step #7 (see FIG. 2) and the invention coating at step #9 (the photomicrographs are at 100X magnification). Corresponding photomicrographs at 400X are shown in FIGS. 4A and 4B. From these results, the invention coating shows improved image quality over the control as well as more finely dispersed filamentary silver.

Electron microscopic cross sections of exposed and processed coatings taken from a step at density of ~0.4 are shown for the control and invention coatings at magnifications of 22,000X. FIGS. 5A and 5B, respectively.

These results show a more even distribution of the developed silver (2*a*) throughout the emulsion layer as well as more finely dispersed filamentary-type silver in the invention coating compared to the control coating, which showed a concentration of developed silver near the support (1*a*) surface.

Developer I

| Component | g/l |
|---|---|
| Water, tap | 850.0 |
| Ethylenediaminotetraacetic acid | 1.0 |
| KOH, 45% | 22.0 |
| 5-Methylbenzotriazole | adjusted as needed |
| 1-Phenyl-5-mercaptotetrazole | |
| $Na_2SO_3$, anhydrous | 75.0 |
| 4,4'-Dimethyl-1-phenyl-3-pyrazolidinone | 0.4 |
| NaBr | 8.0 |
| 2-Ethylaminoethanol | 58.6 |
| 3.3'-Diaminodipropylamine | 4.0 |
| Hydroquinone | 40.0 |
| KOH, 45% (adjusted pH to 10.7 at 27° C.) | 7.0 |
| Water, tap to 1 liter | |

EXAMPLE 2

I. Coatings

Control and Example coatings were prepared essentially similar to those of Example 1, except that 1 percent by weight formaldehyde was used to harden the overcoat rather than bis(vinylsulfonylmethyl) ether hardener and for the nucleating agent the following nucleating agents were substituted 1-[4-(2-formylhydrazino)phenyl]-3-hexylurea (276 mg/Ag mole) and 1-formyl-2-{4-[2-(2,4-di-tertpentylphenoxy)-butyramido]phenyl}hydrazine (78 mg/Ag mole).

II. Processing

Both control and example coatings were exposed and processed for 104 sec (38° C.) in Developer II plus 0.05 g AF-3/l+0.08 g PMT/l.

III. Sensitometry

Figure 6:
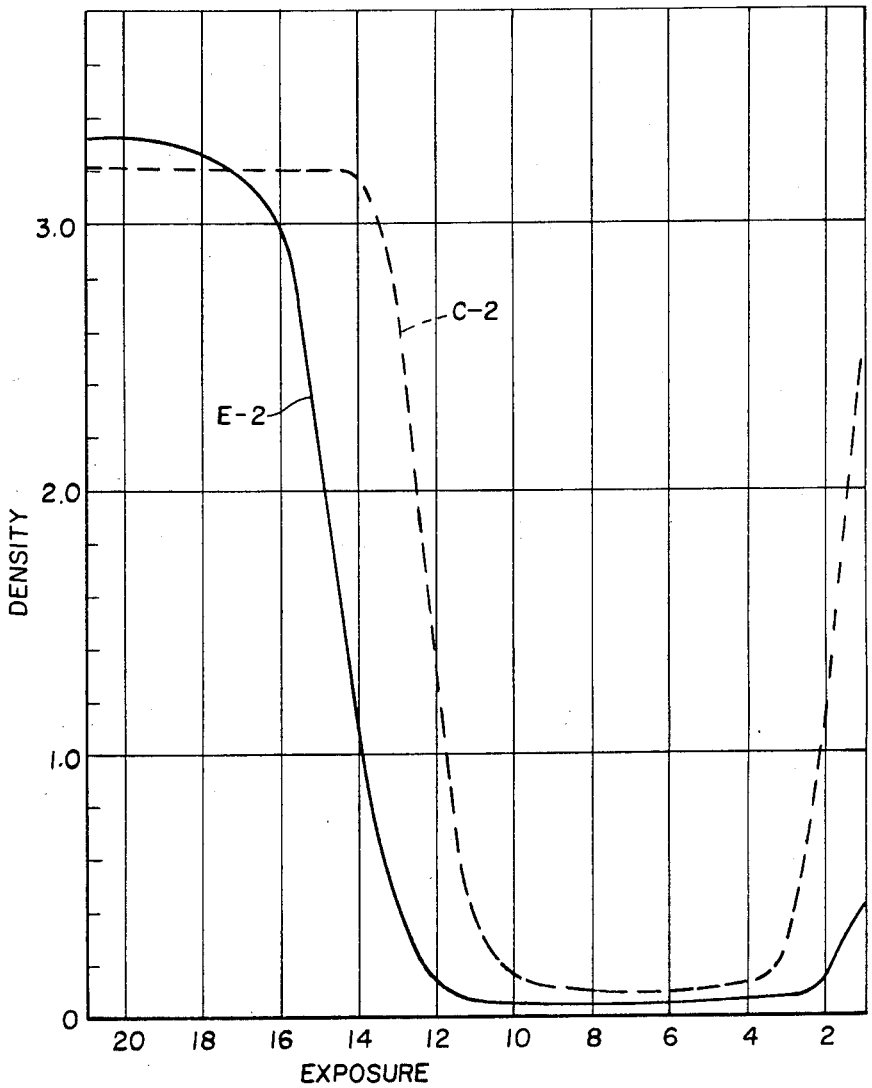

The sensitometric results are shown in FIG. 6, and Table III

TABLE III

| | Sensitometric Results | | | |
|---|---|---|---|---|
| Coating | Relative Log Speed* | Contrast | D-max | D-min |
| Control (C-2) | 257 | 9.9 | 3.24 | 0.09 |

TABLE III-continued

| Coating | Sensitometric Results Relative Log Speed* | Contrast | D-max | D-min |
|---|---|---|---|---|
| Example (E-2) | 286 | 6.7 | 3.35 | 0.04 |

*Speed as described in Example 1.

As the results in Table III and FIG. 6 show, the effect of AF-3 in the undercoat was to increase speed and D-max, decrease D-min, and to increase the speed separation between the positive and negative responses compared to the control.

IV. Image Quality

Photomicrographs, taken in a similar manner to that of Example 1, showed similar improvement in the image quality of the example over the control.

| Developer II Component | g/l |
|---|---|
| Water, tap | 850.0 |
| Ethylenediaminotetraacetic acid | 1.0 |
| KOH, 45% | 22.0 |
| 5-Methylbenzotriazole | adjusted |
| 1-Phenyl-5-mercaptotetrazole | as needed |
| $Na_2SO_3$, anhydrous | 60.0 |
| 4,4'-Dimethyl-1-phenyl-3-pyrazolidinone | 0.6 |
| NaBr | 3.0 |
| 2-Ethylaminoethanol | 58.6 |
| 3.3'-Diaminodipropylamine | 4.0 |
| Hydroquinone | 40.0 |
| KOH, 45% (adjusted pH to 10.9 at 27° C.) | 7.0 |
| Water, tap to 1 liter | |

EXAMPLE 3

I. Coatings

A. Control Coating (C-2): The control coating of Example 2 was again prepared, but with 6.73 g/m$^2$ silver and 157 mg/Ag mole of Dye A.

B. Control Coating (C-3): This control coating was similar to control coating C-2, but contained 6.91 gram of silver per square meter and additionally contained in the silver halide emulsion layer $1.76\times10^{-2}$ mole of AF-3 per silver mole.

C. Example Coating (E-3) This coating was similar to the Example 2 coating E-2, but contained 6.69 gram of silver per square meter and contained in the undercoat $1.82\times10^{-2}$ mole of AF-3 per silver mole. The silver coverages and AF-3 concentrations in coatings C-3 and E-3 were substantially matched, the only material difference between these coatings being the presence of AF-3 in the undercoat of coating E-3 as opposed to the silver halide emulsion layer in coating C-3.

II. Processing

All coatings were exposed and processed for 75 seconds (38° C.) in Developer III.

III. Sensitometry

Figure 7:
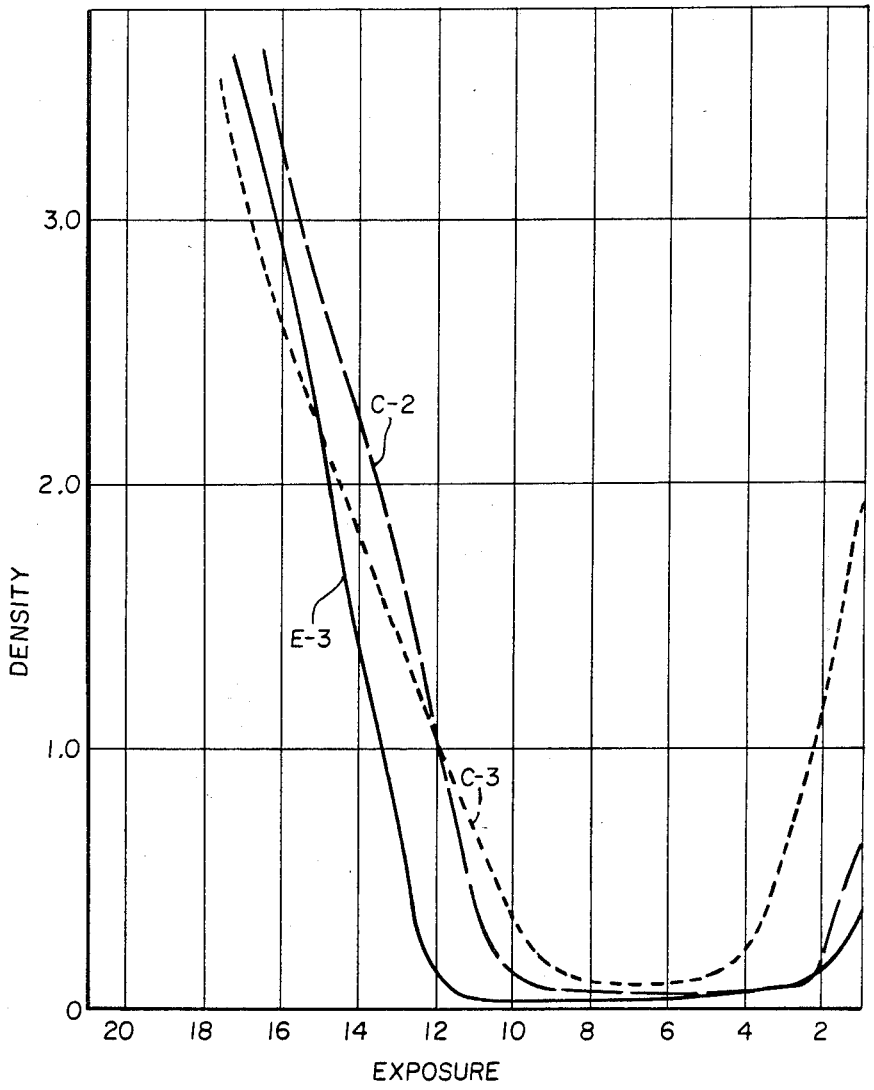

Sensitometric results are shown in FIG. 7 and Table IV.

TABLE IV

| Coating | Sensitometric Results Reversal (Positive Image) Log Speed* | Contrast | D-max | D-min |
|---|---|---|---|---|
| Control (C-2) | 257 | 3.8 | 4.1 | 0.06 |
| Control (C-3) | 247 | 2.5 | 4.5 | 0.10 |
| Example (E-3) | 282 | 5.0 | 4.0 | 0.03 |

*Speed as described in Example 1.

The results in Table IV and FIG. 7 show that the example coating E-3 with AF-3 in the undercoat yielded higher speed, higher contrast, lower minimum density (D-min), and increased exposure separation of the rereversal image compared to control coating C-2, which did not contain AF-3, and control coating C-3, which contained AF-3 in the silver halide emulsion layer. The location of the maximum density enhancing antifoggant in the undercoat produced these differences in performance.

| Developer III Component | g/l |
|---|---|
| Water, tap | 850.0 |
| Ethylenediaminotetraacetic acid | 1.0 |
| KOH, 45% | 22.0 |
| AF-3 | 0.05 |
| 1-Phenyl-5-mercaptotetrazole | 0.08 |
| $Na_2SO_3$, anhydrous | 60.0 |
| 4,4'-Dimethyl-1-phenyl-3-pyrazolidinone | 0.6 |
| NaBr | 3.0 |
| 2-Ethylaminoethanol | 58.6 |
| 3.3'-Diaminodipropylamine | 4.0 |
| Hydroquinone | 40.0 |
| KOH, 45% (adjusted pH to 10.9 at 27° C.) | 7.0 |
| Water, tap to 1 liter | |

EXAMPLE 4

I. Coatings

A. Control Coating (C-4a): This coating was prepared as described for control coating C-2, but with 6.47 g/m$^2$ silver in the emulsion layer.

B. Control Coating (C-4b): This coating was similar to control coating C-4a, but contained benzotriazole (AF-1) at $3.76\times10^{-3}$ mole per silver mole in the emulsion layer.

C. Example Coating (E-4): This coating was similar to control coating C-4B, but contained the benzotriazole (AF-1) at the same level in an undercoat with 1.29 g/m$^2$ gelatin.

II. Processing

All coatings were exposed as described for Example 1 and processed for 75 seconds at 38° C. in Developer III.

III. Sensitometry

Sensitometric results are shown in Table V.

TABLE V

| Coating | Sensitometric Results Reversal (Positive Image) Log Speed* | Contrast | D-max | D-min |
|---|---|---|---|---|
| Control (C-4a) | 267 | 7.1 | 4.0 | 0.10 |
| Control (C-4b) | 270 | 6.5 | 4.0 | 0.12 |
| Example (E-4) | 277 | 6.6 | 4.0 | 0.07 |

*Speed as described in Example 1.

The results in Table V show that the example coating E-4 with AF-1 in the undercoat yielded higher speed and lower D-min compared to control coating C-4a, which did not contain AF-1, and control coating C-4b, which contained AF-1 in the silver halide emulsion layer. Also, increased exposure separation of the rereversal image was observed.

EXAMPLE 5

I. Coatings

A. Control Coating (C-5a): Identical to control coating C-4a.

B. Control Coating (C-5b): This coating was similar to control coating C-5a, but contained 5-chlorobenzotriazole, AF-11, at $7.0\times10^{-4}$ mole per silver mole in the emulsion layer.

C. Example Coating (E-5): This coating was similar to control coating C-5b, but contained the 5-chlorobenzotriazole (AF-11) at the same level in an undercoat coated with 1.29 g/m$^2$ gelatin.

II. Processing

All coatings of Example 5 were exposed and processed as described in Example 4.

III. Sensitometry

Sensitometric results are shown in Table VI.

TABLE VI

| | Sensitometric Results | | | |
|---|---|---|---|---|
| | Reversal (Positive Image) | | | |
| Coating | Log Speed* | Contrast | D-max | D-min |
| Control (C-5a) | 267 | 7.1 | 4.0 | 0.10 |
| Control (C-5b) | — | — | 4.0 | 4.0 |
| Example (E-5) | 272 | 5.8 | 4.0 | 0.07 |

*Speed as described in Example 1.

The results of Table VI show that the example coating E-5 with AF-11 in the undercoat yielded higher speed and lower D-min compared to control coating C-5a, which did not contain AF-11. Control coating C-5b, which contained the AF-11 in the silver halide emulsion layer, showed only a constant D-max density without image discrimination.

EXAMPLE 6

I. Coatings

A. Control Coating (C-6a): A chemically sensitized core-shell AgBr emulsion as described for Example 1 was coated on a polyester film support at 5.33 g/m$^2$ silver and 3.99 g/m$^2$ gelatin. The emulsion was spectrally sensitized with 200 mg/mole Ag of Dye B and 156 mg/mole Ag of Dye C, anhydro-1,3'-bis-(3-sulfopropyl)naphtho[1,2,-d]thiazolothiacyanine hydroxide, triethylamine salt, and 276 mg/Ag mole of the nucleating agent 1-[4-(2-formyl-hydrazino)phenyl]-3-hexylurea was added. The emulsion also contained 36.4 g/mole Ag of low molecular weight polyacrylamide as described in Allentoff and Minsk U.S. Pat. No. 3,271,158. The emulsion was overcoated with 1.08 g/m$^2$ of gelatin, and hardened with formaldehyde at 1% by weight based on the total gelatin content.

B. Control Coating (C-6b): This coating was similar to control coating C-6a, but contained 5-methylbenzotriazole, AF-3, at $2.0\times10^{-3}$ mole per silver mole in the emulsion layer.

C. Example Coating (E-6): This coating was similar to control coating C-6b, but contained the 5-methylbenzotriazole (AF-3) at the same level in an undercoat coated with 1.29 g/m$^2$ gelatin.

II. Processing

All coatings of Example 6 were exposed and processed as described for Example 4.

III. Sensitometry

Sensitometric results are shown in Table VII.

TABLE VII

| | Sensitometric Results | | | |
|---|---|---|---|---|
| | Reversal (Positive Image) | | | |
| Coating | Log Speed* | Contrast | D-max | D-min |
| Control (C-6a) | 301 | 7.6 | 4.0 | 0.07 |
| Control (C-6b) | 290 | 4.3 | 3.6 | 0.16 |
| Example (E-6) | 323 | 5.6 | 4.0 | 0.06 |

*Speed as described in Example 1.

The results in Table VII show that the example coating E-6 with AF-3 in the undercoat yielded higher speed than control coating C-6a which did not contain AF-3. When compared to control coating C-6a which contained AF-3 in the emulsion layer, example coating E-6 showed higher speed, contrast, and D-max. Also, a greater exposure separation of the rereversal image was observed.

EXAMPLE 7

I. Coatings

A. Control Coating (C-7a): This coating was prepared similarly to control coating C-6a.

B. Control Coating (C-7b): This coating was similar to control coating C-7a but contained benzotriazole, AF-1, at $4.6\times10^{-3}$ mole per silver mole in the emulsion layer.

C. Example Coating (E-7): This coating was similar to control coating C-7b but contained the benzotriazole (AF-1) at the same level in an undercoat coated with 1.29 g/m$^2$ gelatin.

II. Processing

All coatings of Example 7 were exposed and processed as described for Example 4.

III. Sensitometry

Sensitometric results are shown in Table VIII.

TABLE VIII

| | Sensitometric Results | | | |
|---|---|---|---|---|
| | Reversal (Positive Image) | | | |
| Coating | Log Speed* | Contrast | D-max | D-min |
| Control (C-7a) | 280 | 7.3 | 4.0 | 0.09 |
| Control (C-7b) | 287 | 5.9 | 3.8 | 0.14 |
| Example (E-7) | 304 | 7.0 | 4.0 | 0.06 |

*Speed as described in Example 1.

The results in the Table VIII show that the example coating E-7 with AF-1 in the undercoat yielded higher speed and lower D-min than the control coating C-7a without AF-1. As compared to control coating C-7b with AF-1 in the emulsion, example coating E-7 showed higher speed, contrast, and D-max, and reduced D-min. Also, a greater exposure separation of the rereversal image was observed.

EXAMPLE 8

I. Coatings

A. Control Coating (C-8a): This coating was identical with coating C-7a.

B. Control Coating (C-8b): This coating was similar to control coating C-8a, but contained 5-chlorobenzotriazole, AF-11, at $1.8\times10^{-3}$ mole per silver mole in the emulsion layer.

C. Example Coating (E-8): This coating was similar to control coating C-8b, but contained the 5-chlorobenzotriazole (AF-11) at the same level in an undercoat coated with 1.29 g/m$^2$ gelatin.

II. Processing

All coatings of Example 8 were exposed and processed as described for Example 4.

III. Sensitometry

Sensitometric results are shown in Table IX.

TABLE IX

| | Sensitometric Results | | | |
|---|---|---|---|---|
| | Reversal (Positive Image) | | | |
| Coating | Log Speed* | Contrast | D-max | D-min |
| Control (C-8a) | 280 | 7.3 | 4.0 | 0.09 |
| Control (C-8b) | — | — | 4.0 | 4.0 |
| Example (E-8) | 302 | 6.2 | 3.9 | 0.07 |

*Speed as described in Example 1.

The results of Table IX show that the example coating E-8 with AF-11 in the undercoat yielded higher speed and lower D-min compared to control coating C-8a, which did not contain AF-11. Control coating C-8b, which contained the AF-11 in the silver halide emulsion layer, showed only a constant D-max density without image discrimination, as did control coating C-5b with AF-11 in the emulsion.

The invention has been described with particular reference to preferred embodiments thereof, but it will be understood that variations and modifications can be effected within the spirit and scope of the invention.

What is claimed is:

1. In a black and white direct positive photographic element intended for the formation of a viewable silver image and comprised of a support, one or more radiation sensitive emulsion layers containing internal latent image forming silver halide grains, and a maximum density enhancing 1,2,3-triazole antifoggant, further characterized in that said maximum density enhancing 1,2,3-triazole antifoggant is located in an undercoat between said emulsion layers and said support.

2. A black and white direct positive photographic element according to claim 1 additionally including a nucleating agent.

3. A black and white direct positive photographic element according to claim 2 wherein said nucleating agent is chosen from the class consisting of aromatic hydrazide nucleating agents, N-substituted cycloammonium quaternary salt nucleating agents, and mixtures thereof.

4. A black and white direct positive photographic element according to claim 2 wherein said nucleating agent is a hydrazide of the formula

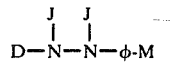

wherein

J is in one occurrence hydrogen and in the other occurrence hydrogen or a sulfinic acid radical derived substituent;

Φ is a phenylene group; and

M is a moiety capable of restricting mobility.

5. A black and white direct positive photographic element according to claim 1 wherein said silver halide grains are core-shell silver halide grains.

6. A black and white direct positive photographic element according to claim 1 wherein said 1,2,3-triazole antifoggant is present in concentration of from $5\times10^{-4}$ to 0.1 mole per silver mole.

7. A black and white direct positive photographic element according to claim 1 wherein said 1,2,3-triazole includes a fused aromatic ring.

8. In a black and white direct positive photographic element intended for the formation of a viewable silver image and comprised of a support, one or more radiation sensitive emulsion layers containing internal latent image forming core-shell silver halide grains, and a benzotriazole maximum density enhancing antifoggant, further characterized in that said benzotriazole antifoggant is located in an undercoat between said emulsion layers and said support.

9. A black and white direct positive photographic element according to claim 12 wherein said benzotriazole antifoggant is present in said undercoat in a concentration of from $10^{-3}$ to $5\times10^{-2}$ mole per silver mole.

10. In a black and white direct positive photographic element intended for the formation of a viewable silver image and comprised of a polymeric film support, one or more radiation sensitive emulsion layers containing internal latent image forming core-shell silver bromide or silver bromoiodide grains and an aromatic hydrazide nucleating agent, and a maximum density enhancing antifoggant chosen from the class consisting of benzotriazole, 5-methylbenzotriazole, and 5-chlorobenzotriazole, the improvement wherein said antifoggant is located nearer said support than any emulsion layer and in a concentration of from $10^{-3}$ to $5\times10^{-2}$ mole per silver mole.

11. Processing in a surface developer an imagewise exposed photographic element according to claim 1

(a) in the presence of a nucleating agent or (b) with light flashing of the exposed photographic element during processing.

* * * * *